US010315074B2

(12) United States Patent
Poeschl

(10) Patent No.: US 10,315,074 B2
(45) Date of Patent: Jun. 11, 2019

(54) RE-CONFIGURABLE MULTI-PURPOSE EXERCISE DEVICE

(71) Applicant: Matthew J. Poeschl, Brooklyn, NY (US)

(72) Inventor: Matthew J. Poeschl, Brooklyn, NY (US)

(73) Assignee: TRAVEL TRAINR, LLC, New York, NY (US)

( * ) Notice: Subject to any disclaimer, the term of this patent is extended or adjusted under 35 U.S.C. 154(b) by 79 days.

(21) Appl. No.: 15/672,474

(22) Filed: Aug. 9, 2017

(65) Prior Publication Data

US 2018/0043213 A1 Feb. 15, 2018

Related U.S. Application Data

(60) Provisional application No. 62/372,509, filed on Aug. 9, 2016.

(51) Int. Cl.
*A63B 21/00* (2006.01)
*A63B 5/20* (2006.01)
(Continued)

(52) U.S. Cl.
CPC ..... *A63B 26/00* (2013.01); *A63B 5/20* (2013.01); *A63B 21/068* (2013.01); *A63B 21/4035* (2015.10); *A63B 22/0002* (2013.01); *A63B 22/20* (2013.01); *A63B 23/0211* (2013.01); *A63B 23/1236* (2013.01); *A63B 21/0442* (2013.01); *A63B 21/0557* (2013.01);
(Continued)

(58) Field of Classification Search
CPC . A63B 26/00; A63B 21/4035; A63B 23/0211; A63B 23/1236; A63B 5/20; A63B 22/20; A63B 22/0002; A63B 21/068; A63B 71/0036; A63B 2208/0219; A63B 23/1209; A63B 2210/50; A63B 22/0007; A63B 21/153; A63B 21/0557; A63B 21/0442; A63B 2022/0035
See application file for complete search history.

(56) References Cited

U.S. PATENT DOCUMENTS

2002/0123416 A1* 9/2002 Huang ..... A63B 21/153 482/140
2009/0186750 A1* 7/2009 Hauser ..... A63B 21/00047 482/141

(Continued)

*Primary Examiner* — Andrew S Lo
(74) *Attorney, Agent, or Firm* — Michael B. Dodd; Dodd, Call, Black, PLLC

(57) ABSTRACT

The present invention extends to a re-configurable multi-purpose exercise device. In general, aspects include a re-configurable multi-purpose exercise device that can be configured as an abdominal roller, a pair of pushup stands, or a jump rope. Some aspects include a first roller and a second roller that can attach to one another by mating extending members formed on each respective roller with slots formed on each respective roller. A first handle and a second handle can attach to one or another of the respective rollers by either attaching to the extending members on the rollers or inserting through a hole formed in the rollers. A rope can connect on each end to the first handle and the second handle to form a jump rope. Additionally, some aspects include a two-piece cavity configured for storing the rope.

20 Claims, 17 Drawing Sheets

(51) Int. Cl.

| | |
|---|---|
| ***A63B 26/00*** | (2006.01) |
| ***A63B 22/00*** | (2006.01) |
| ***A63B 22/20*** | (2006.01) |
| ***A63B 21/068*** | (2006.01) |
| ***A63B 23/02*** | (2006.01) |
| ***A63B 23/12*** | (2006.01) |
| *A63B 71/00* | (2006.01) |
| *A63B 21/04* | (2006.01) |
| *A63B 21/055* | (2006.01) |

(52) U.S. Cl.
CPC ..... *A63B 21/153* (2013.01); *A63B 22/0007* (2013.01); *A63B 23/1209* (2013.01); *A63B 71/0036* (2013.01); *A63B 2022/0035* (2013.01); *A63B 2208/0219* (2013.01); *A63B 2210/50* (2013.01)

(56) References Cited

U.S. PATENT DOCUMENTS

2010/0317496 A1* 12/2010 Abranchess ..... A63B 21/0004 482/141
2011/0160024 A1* 6/2011 Candela ..... A63B 23/0211 482/132
2012/0157274 A1* 6/2012 MacColl ..... A63B 21/0004 482/132
2012/0309599 A1* 12/2012 Miller, Jr. ..... A63B 22/20 482/139
2012/0322633 A1* 12/2012 Holman ..... A63B 21/028 482/123
2013/0123079 A1* 5/2013 Peritz ..... A63B 22/14 482/139
2013/0310234 A1* 11/2013 Miller, Jr. ..... A63B 22/20 482/139
2013/0316886 A1* 11/2013 Lynch ..... A63B 26/003 482/146
2014/0018217 A1* 1/2014 Brown ..... A63B 22/20 482/132
2014/0274608 A1* 9/2014 Domesick ..... A63B 23/02 482/132
2015/0182792 A1* 7/2015 MacColl ..... A63B 21/0004 482/132
2015/0328491 A1* 11/2015 Miller ..... A63B 21/00185 482/82
2016/0016037 A1* 1/2016 Chang ..... A63B 21/0724 482/141
2016/0030797 A1* 2/2016 Erickson ..... A63B 21/068 482/132
2016/0045782 A1* 2/2016 Wong ..... A63B 23/0211 482/132
2016/0067541 A1* 3/2016 Lopez ..... A63B 23/03575 482/124
2017/0050065 A1* 2/2017 Carter ..... A63B 21/1645
2017/0209727 A1* 7/2017 Miller ..... A63B 21/00185

* cited by examiner

RE-CONFIGURABLE MULTI-PURPOSE EXERCISE DEVICE

CROSS-REFERENCE TO RELATED APPLICATIONS

This application claims the benefit of and priority to United States Provisional Patent Application Ser. No. 62/372,509, entitled "RE-CONFIGURABLE MULTI-PURPOSE EXERCISE DEVICE", filed Aug. 9, 2016 by Matthew J. Poeschl, the entire contents of which are hereby expressly incorporated by reference.

BACKGROUND

1. Field of the Invention

The invention relates to the field of exercise devices, and in particular to a re-configurable multi-purpose exercise device.

2. Background and Relevant Art

Abdominal rolling, pushups, and jumping rope are well known exercises that can be beneficial for a person. Thus, a person may use a different exercise device for each different exercise he or she performs. Depending on the number of different exercises a person wishes to perform, he or she can purchase many different exercise devices. However, depending on the size and/or weight of the different exercise devices, it can be cumbersome and/or difficult for the person to store multiple different exercise devices, for example, when not in use. Moreover, it can also be cumbersome and/or difficult for the person to travel with the multiple different exercise devices.

BRIEF SUMMARY

The present invention extends to a re-configurable multi-purpose exercise device. In one aspect, a re-configurable multi-purpose exercise device includes a first handle, a second handle, a first roller, a second roller, a connecting piece, and a rope. The re-configurable multi-purpose exercise device can be configured for abdominal rolling by inserting the connecting piece through holes in the center of each roller, thereby causing a first side of each roller to face each other, and then attaching one of the first or second handles to each end of the connecting piece. The re-configurable multi-purpose exercise device can also be configured for pushups by placing a second side of each roller on a support surface and attaching one of the first or second handles to extending members on each of the first and second rollers. The re-configurable multi-purpose exercise device can further be configured for jumping rope by attaching one of the first or second handles to each end of the rope.

In another aspect, a re-configurable multi-purpose exercise device includes an inner disc on each of the first and second rollers and an outer disc on each of the first and second rollers. Additionally, the inner disc of the first roller is configured to rotate with respect to the outer disc of the first roller and the inner disc of the second roller is configured to rotate with respect to the outer disc of the second roller. Accordingly, in this aspect, the re-configurable multi-purpose exercise device can be configured for rotating pushups.

In a further aspect, a re-configurable multi-purpose exercise device includes a first and second roller, each of which includes first and second extending members and first and second slots. When the re-configurable multi-purpose exercise device is configured for abdominal rolling, the first and second extending members of one of the first or second rollers mates with the slots of the other one of the first or second rollers.

In an even further aspect, a re-configurable multi-purpose exercise device includes a two-piece cavity that includes first and second pieces that are selectively attachable to and detachable from one another. The two-piece cavity can be configured to store a rope and be contained between the first sides of the first and second rollers. Each of the first and second pieces include an extended portion configured to pass through either of a hole passing through the first roller or a hole passing through the second roller. Additionally, to configure the multi-purpose exercise device for abdominal rolling, each extended portion includes an attachment mechanism for attaching to an attachment mechanism of one of the first or second handles.

BRIEF DESCRIPTION OF THE DRAWINGS

In order to describe the manner in which the aspects and features of the invention can be obtained, a more particular description of the invention briefly described above will be rendered by reference to specific aspects thereof which are illustrated in the appended drawings. Understanding that these drawings depict only typical aspects of the invention and are not therefore to be considered to be limiting of its scope, the invention will be described and explained with additional specificity and detail through the use of the accompanying drawings in which.

DETAILED DESCRIPTION

Figure 1:
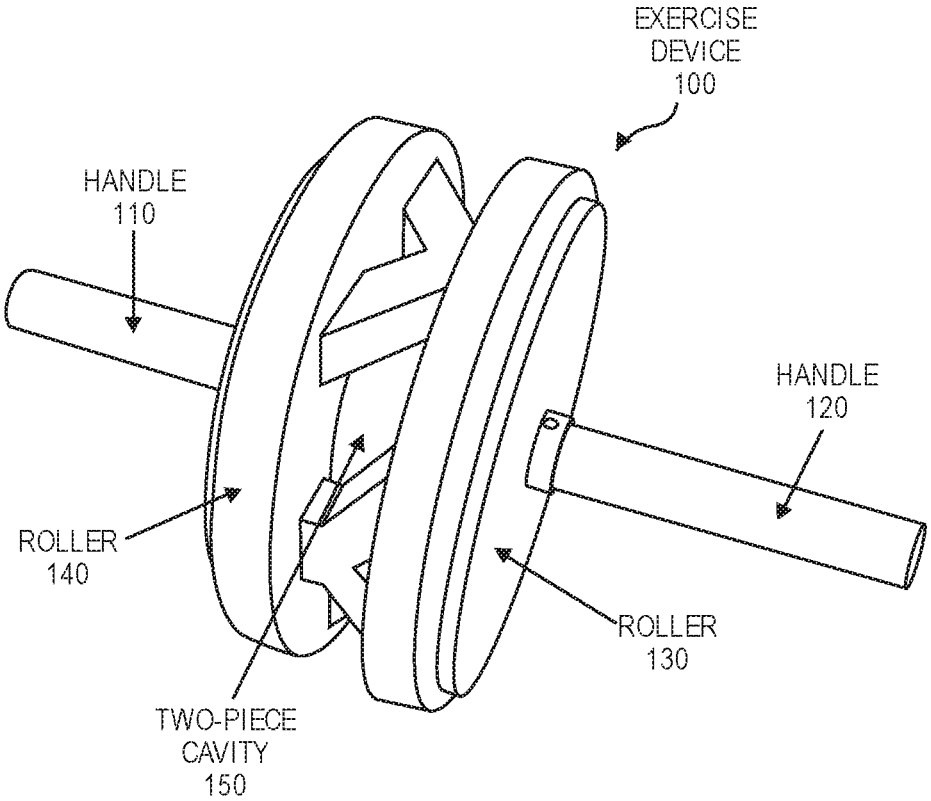
FIG. 1 illustrates an example re-configurable multi-purpose exercise device configured for abdominal rolling.

The present invention extends to a re-configurable multi-purpose exercise device. In one aspect, a re-configurable multi-purpose exercise device can be re-configured between different configurations to facilitate each of abdominal rolling, pushups, or jumping rope.

A multi-purpose exercise device includes a first handle, a second handle, a first roller, a second roller, a connecting piece, and a rope. Each of the first handle and the second handle include an attachment mechanism configured to attach to any of the attachment mechanisms of the connecting piece or the rope.

The first roller has a first side that includes a first extending member and a second extending member that extend out of the first side. The first roller also includes a hole passing through the first roller. The first extending member and the second extending member that extend out of the first side of the first roller are collectively configured to receive one of the first handle or the second handle to configure the multi-purpose exercise device for pushups.

The second roller has a first side that includes a first extending member and a second extending member that extend out of the first side. The second roller further includes a hole passing through the second roller. The first extending member and the second extending member that extend out of the first side of the second roller are collectively configured to receive one of the first handle or the second handle to configure the multi-purpose exercise device for pushups.

The connecting piece is configured to pass through the hole passing through the first roller and the hole passing through the second roller. Additionally, each end of the connecting piece includes an attachment mechanism for attaching to the attachment mechanism of one of the first handle or the second handle to configure the multi-purpose exercise device for abdominal rolling.

Each end of the rope includes an attachment mechanism for attaching to the attachment mechanism of one of the first handle or the second handle to configure the multi-purpose exercise device for jumping rope.

The multi-purpose exercise device can be configured for abdominal rolling. The first side of the first roller is faced to the first side of the second roller. Additionally, the connecting piece is passed through the hole passing through the first roller and the hole passing through the second roller. The attachment mechanism of one of the first handle or the second handle is attached to the attachment mechanism at one end of the connecting piece. The attachment mechanism of the other of the first handle or the second handle is attached to the attachment mechanism at the other end of the connecting piece.

The multi-purpose exercise device can also be configured for pushups. One of the first handle or the second handle is received by the first extending member and the second extending member that extend out of the first side of the first roller. The other of the first handle or the second handle is received by the first extending member and the second extending member that extend out of the first side of the second roller.

Furthermore, the multi-purpose exercise device can be configured for jumping rope. The attachment mechanism of one of the first handle or the second handle is attached to the attachment mechanism at one end of the rope. The attachment mechanism of the other of the first handle or the second handle is attached to the attachment mechanism at the other end of the rope.

In another aspect, a multi-purpose exercise device includes a first handle, a second handle, a first roller including an outer disc and inner disc, a second roller including an outer disc and an inner disc, a connecting piece, and a rope. Each of the first handle and the second handle include an attachment mechanism configured to attach to any of the attachment mechanisms of the connecting piece or the rope.

The first roller includes the outer disc and the inner disc which are rotatable with respect to one another. The outer disc includes a first extending member and a second extending member that extend out of the outer disc. The outer disc also includes a first slot and a second slot formed in the outer disc for receiving a first extending member and a second extending member that extend out of the outer disc of the second roller. The first roller further includes a hole passing through the outer disc and the inner disc of the first roller. The first extending member and the second extending member that extend out of the outer disc of the first roller are collectively configured to receive one of the first handle or the second handle to configure the multi-purpose exercise device for pushups.

The second roller includes the outer disc and the inner disc which are rotatable with respect to one another. The outer disc includes the first extending member and the second extending member that extend out of the outer disc. The outer disc also includes a first slot and a second slot formed in the outer disc for receiving the first extending member and the second extending member that extend out of the outer disc of the first roller. The second roller further includes a hole passing through the outer disc and the inner disc of the second roller. The first extending member and the second extending member that extend out of the outer disc of the second roller are collectively configured to receive one of the first handle or the second handle to configure the multi-purpose exercise device for pushups.

The connecting piece is configured to pass through the hole passing through the outer disc and the inner disc of the first roller and the hole passing through the outer disc and the inner disc of the second roller. Additionally, each end of the connecting piece includes an attachment mechanism for attaching to the attachment mechanism of one of the first handle or the second handle to configure the multi-purpose exercise device for abdominal rolling. Each end of the rope includes an attachment mechanism for attaching to the attachment mechanism of one of the first handle or the second handle to configure the multi-purpose exercise device for jumping rope.

The multi-purpose exercise device can be configured for abdominal rolling. The first extending member and the second extending member that extend out of the outer disc of the first roller are respectively secured into the first slot and the second slot formed in the outer disc of the second roller. Along similar lines, the first extending member and the second extending member that extend out of the outer disc of the second roller are respectively secured into the first slot and the second slot formed in the outer disc of the first roller. Additionally, the connecting piece is passed through the hole passing through the outer disc and the inner disc of the first roller and the hole passing through the outer disc and the inner disc of the second roller. The attachment mechanism of one of the first handle or the second handle is attached to the attachment mechanism at one end of the connecting piece. The attachment mechanism of the other of the first handle or the second handle is attached to the attachment mechanism at the other end of the connecting piece.

The multi-purpose exercise device can also be configured for pushups. One of the first handle or the second handle is connected to the first extending member and the second extending member that extend out of the outer disc of the first roller. The other of the first handle or the second handle is connected to the first extending member and the second extending member that extend out of the outer disc of the second roller.

Moreover, the multi-purpose exercise device can be configured for jumping rope. The attachment mechanism of one of the first handle or the second handle is attached to the attachment mechanism at one end of the rope. The attachment mechanism of the other of the first handle or the second handle is attached to the attachment mechanism at the other end of the rope.

In yet another aspect, a multi-purpose exercise device includes a first handle, a second handle, a first roller, a second roller, a two-piece cavity, and a rope. Each of the first handle and the second handle include an inserting attachment point configured to attach to any receiving attachment points of the two-piece cavity or the rope.

The first roller has a first side and a second side. The first side includes a first extending member and a second extending member that extend out of the first side. The first roller also includes a first slot and a second slot formed in the first side. The second side of the first roller is essentially flat. A hole passes through the first roller from the first side to the second side. The first extending member and the second extending member that extend out of the first side of the first roller are collectively configured to receive one of the first handle or the second handle to configure the multi-purpose exercise device for pushups.

The second roller also has a first side and a second side. The first side includes a first extending member and a second extending member that extend out of the first side. The second roller also includes a first slot and a second slot formed in the first side for receiving the first extending member and the second extending member that extend out of the first side of the first roller. A hole passes through the second roller from the first side of the second side. The first extending member and the second extending member that extend out of the first side of the second roller are collectively configured to receive one of the first handle or the second handle to configure the multi-purpose exercise device for pushups.

The two-piece cavity includes a first piece and a second piece. The first piece and the second piece are selectively attachable to and detachable from one another. The two-piece cavity can be configured to store a rope and be contained between the first side of the first roller and the first side of the second roller when (a) the first piece and the second piece are attached to one another, (b) the first extending member and the second extending member that extend out of the first side of the first roller are respectively secured into the first slot and the second slot formed in the first side of the second roller, and (c) the first extending member and the second extending member that extend out of the first side of the second roller are respectively secured into the first slot and the second slot formed in the first side of the first roller. Each of the first piece and the second piece include an extended portion configured to pass through either of the hole passing through the first roller or the hole passing through the second roller. Each extended portion includes a receiving attachment point for attaching to the inserting attachment point of one of the first handle or the second handle to configure the multi-purpose exercise device for abdominal rolling.

Each end of the rope includes a receiving attachment point for attaching to the inserting attachment point of one of the first handle or the second handle to configure the multi-purpose exercise device for jumping rope.

The multi-purpose exercise device can be configured for abdominal rolling. The first extending member and the second extending member that extend out of the first side of the first roller are respectively secured into the first slot and the second slot formed in the first side of the second roller. The first extending member and the second extending member that extend out of the first side of the second roller are respectively secured into the first slot and the second slot formed in the first side of the first roller. The inserting attachment point of one of the first handle or the second handle is attached to the receiving attachment point of the extended portion of one of the first piece of the two-piece cavity or the second piece of the two-piece cavity. The inserting attachment point of the other of the first handle or the second handle is attached to the receiving attachment point of the extended portion of the other of the first piece of the two-piece cavity or the second piece of the two-piece cavity.

The multi-purpose exercise device can be configured for pushups. One of the first handle or the second handle is received by the first extending member and the second extending member that extend out of the first side of the first roller. The other of the first handle or the second handle is received by the first extending member and the second extending member that extend out of the first side of the second roller.

The multi-purpose exercise device can be configured for jumping rope. The inserting attachment point of one of the first handle or the second handle is attached to the receiving attachment point at one end of the rope. The inserting attachment point of the other of the first handle or the second handle is attached to the receiving attachment point at the other end of the rope.

FIGS. 1-9 depict a re-configurable multi-purpose exercise device 100 is depicted. Turning initially to FIG. 1, the re-configurable multi-purpose exercise device 100 includes handle 110, handle 120, roller 130, roller 140, and two-piece cavity 150. In FIG. 1, roller 130 is attached to roller 140 with two-piece cavity 150 situated between rollers 130 and 140. Extended portions of two-piece cavity 150 extend through holes in each of rollers 130 and 140. Handle 110 is attached to an extended portion of two-piece cavity 150 that extends through a hole in roller 140. Likewise, handle 120 is attached to an extended portion of two-piece cavity 150 that extends through a hole in roller 130.

Figure 2:
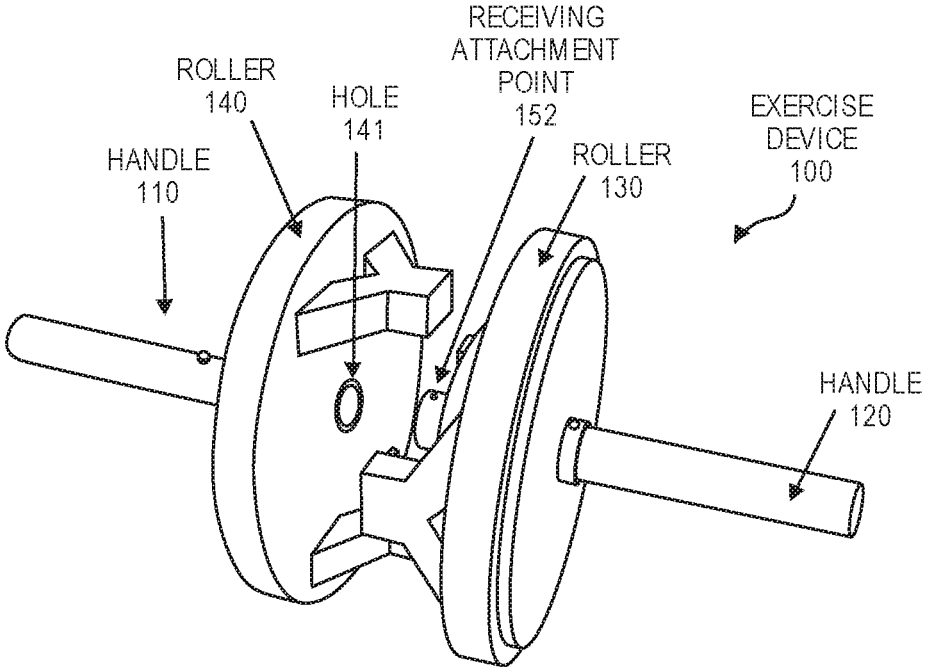
FIG. 2 illustrates a partially exploded view of the example re-configurable multi-purpose exercise device of FIG. 1.

Turning to FIG. 2, a partially exploded view of re-configurable multi-purpose exercise device 100 is depicted to show that roller 140 includes hole 141. Two-piece cavity 150 includes receiving attachment point 152 (e.g., a hole) positioned on the extended portion of two-piece cavity 150 that extends through hole 141 of roller 140.

Figure 3:
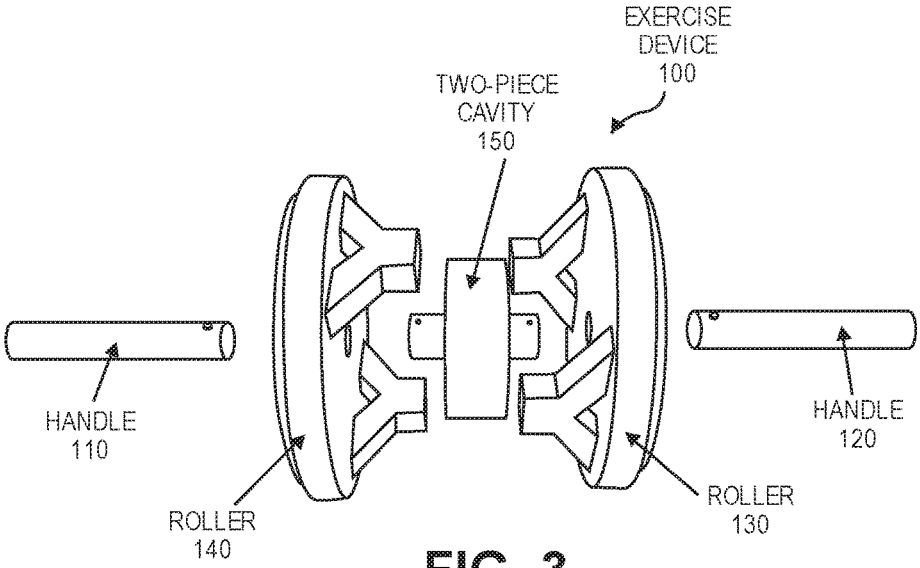
FIG. 3 illustrates a fully exploded view of the example re-configurable multi-purpose exercise device of FIG. 1.

Turning to FIG. 3, a fully exploded view of re-configurable multi-purpose exercise device 100 is depicted to show a disassembled configuration. This disassembled configuration shows the extended portions of two-piece cavity 150 which extend through the holes of rollers 130 and 140 to attach to the handles 110 and 120. Additionally, this disassembled configuration shows that two-piece cavity 150 can be sandwiched between rollers 130 and 140 when the re-configurable multi-purpose exercise device 100 is configured for abdominal rolling. Alternatively, when re-configurable multi-purpose exercise device 100 is disassembled, the various components of re-configurable multi-purpose exercise device 100 can be more efficiently packed and stored as a kit in a carrying case.

Figure 4:
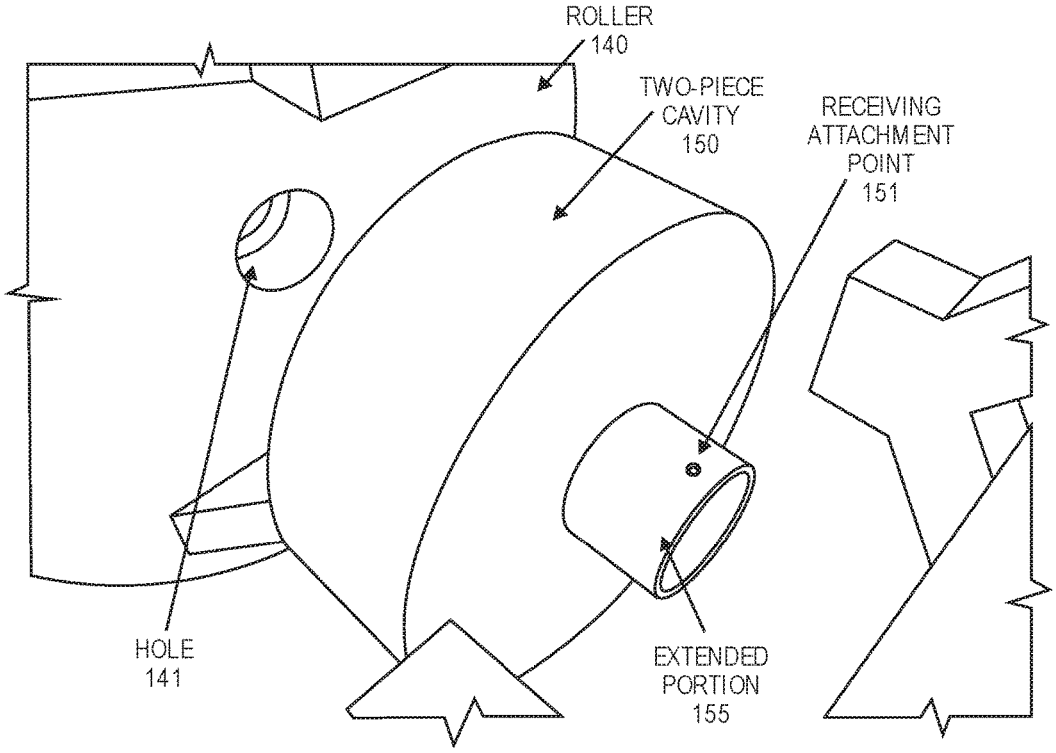
FIG. 4 illustrates a close-up view of a portion of the example re-configurable multi-purpose exercise device of FIG. 1.

Turning to FIG. 4, a close-up view of a portion of re-configurable multi-purpose exercise device 100 is shown. In particular, FIG. 4 depicts that two-piece cavity 150 includes extended portion 155 including receiving attachment point 151 (e.g., a hole). Hole 141 in roller 140 is also depicted.

Figure 5:
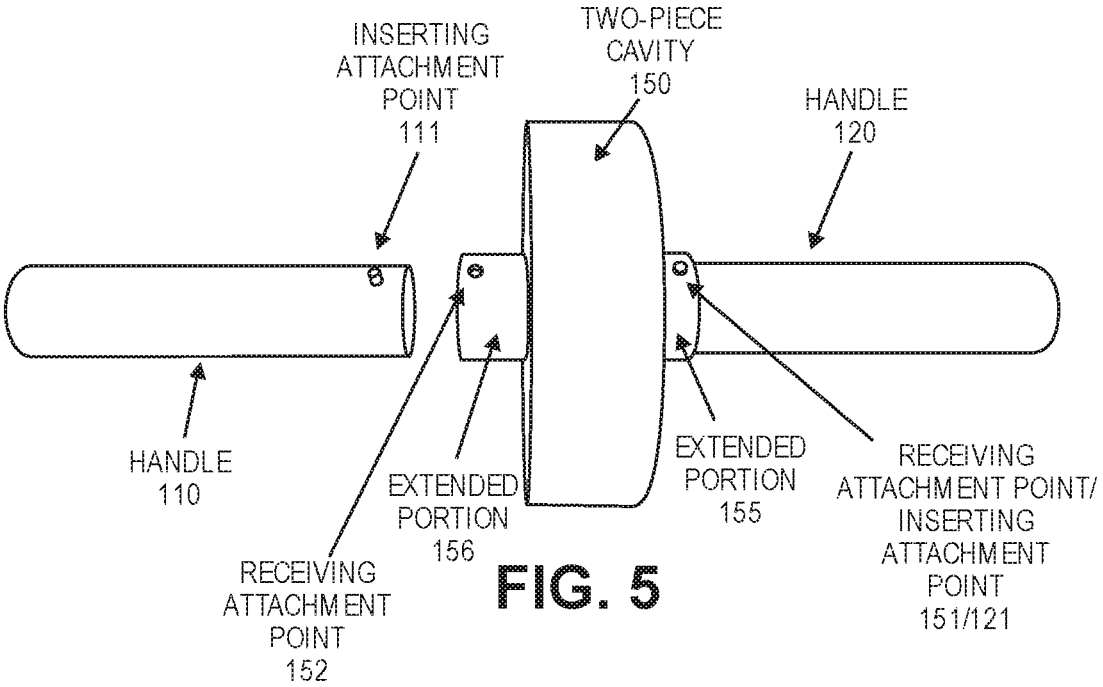
FIG. 5 illustrates an example two-piece cavity and handles of the example re-configurable multi-purpose exercise device of FIG. 1.

Turning to FIG. 5, additional aspects of two-piece cavity 150 and handles 110 and 120 are shown. More specifically, two-piece cavity 150 includes extended portion 155 and extended portion 156. Extended portion 155 and extended portion 156 include receiving attachment points 151 and 152 respectively. Handle 110 includes inserting attachment point 111 (e.g., a depressible spring-loaded component). Similarly, handle 120 includes inserting attachment point 121 (e.g., a depressible spring-loaded component).

FIG. 5 further illustrates that inserting attachment point 121 is attached to receiving attachment point 151 to attach handle 120 to two-piece cavity 150. While FIG. 5 shows that inserting attachment points 111 and 121 attach to receiving attachment points 152 and 151 through the insertion of handles 110 and 120 into extended portions 156 and 155 respectively, alternative attachment mechanisms may be used. For example, handles may include receiving attachment points and extended portions of a two-piece cavity may include inserting attachment points, such that extended portions insert handles to connect the handles and the two-piece cavity together.

Figure 6:
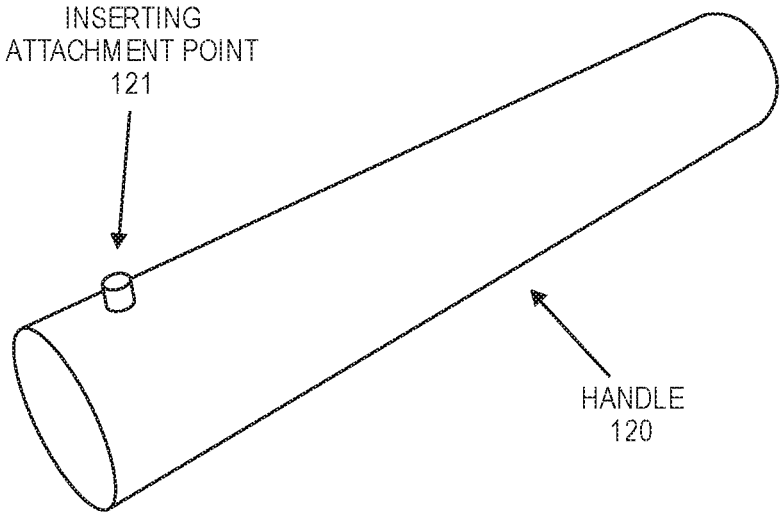
FIG. 6 illustrates an example handle of the example re-configurable multi-purpose exercise device of FIG. 1.

Turning to FIG. 6, a closer view of handle 120 including inserting attachment point 121 is depicted. However, alternative attachment mechanisms may be used on handles.

Figure 7A:
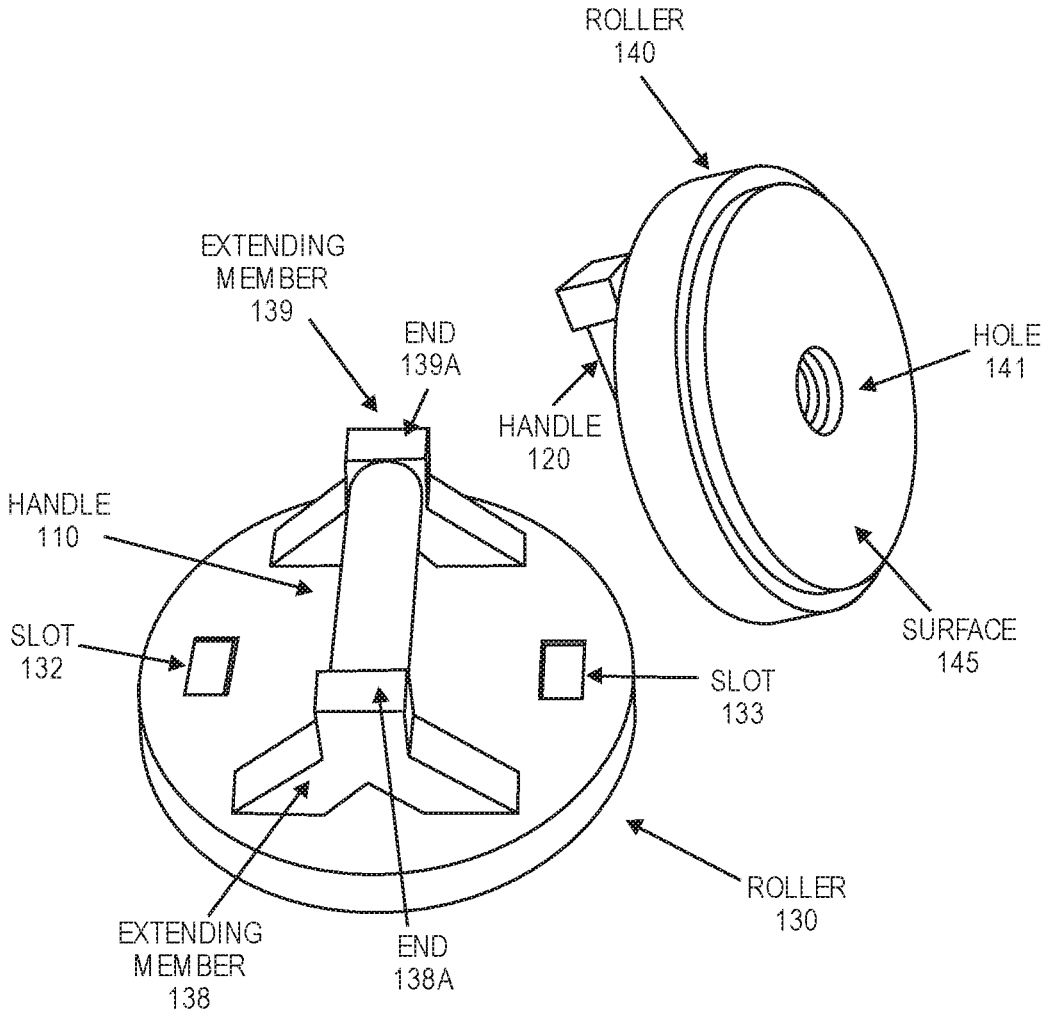
FIGS. 7A-7C illustrate example rollers and handles of the example re-configurable multi-purpose exercise device of FIG. 1 being configured for pushups.

Turning to FIG. 7A, different views of roller 130 and 140 are depicted. As depicted, roller 130 includes extending members 138 and 139 and slots 132 and 133. Extending members 138 and 139 include ends 138A and 139A respectively. Ends 138A and 139A can be inserted into slots on roller 140 (i.e., slots similar to slots 132 and 133). Likewise, ends on extending members of roller 140 (i.e., ends similar to ends 138A and 139A) can be inserted into slots 132 and 133. When corresponding ends and slots are connected, roller 130 is connected to roller 140.

Furthermore, as depicted in FIG. 7A, handle 110 is inserted into extending members 138 and 139. Similarly, handle 120 is inserted into extending members of roller 140. Roller 140 includes an essentially flat surface 145 configured to contact the ground. Roller 130 can include a similar surface. In the configuration shown in FIG. 7A, rollers 130 and 140 can be used to perform pushups.

Figure 7B:
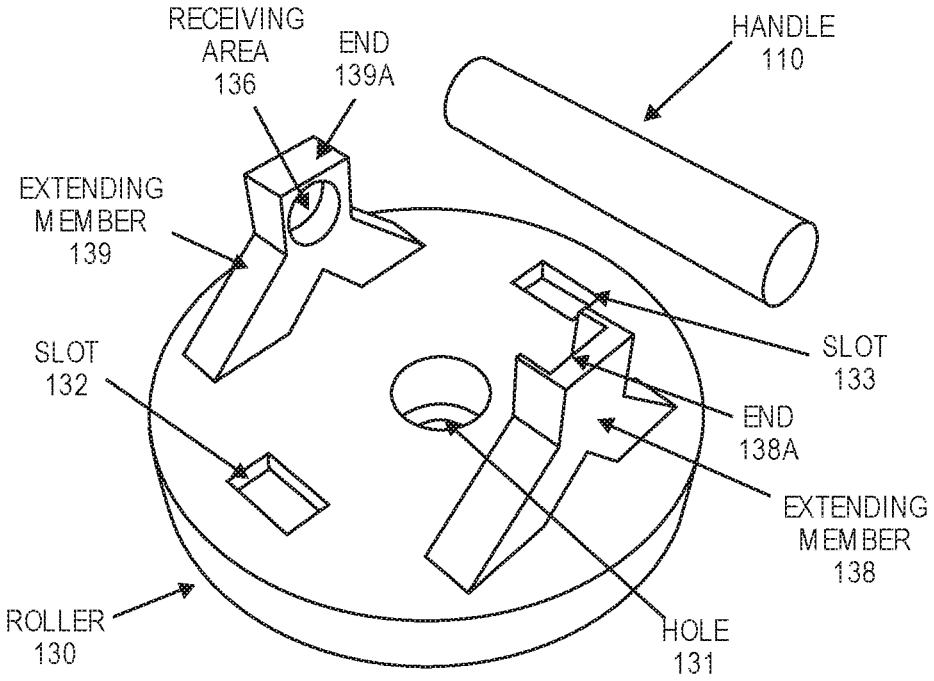
Figure 7C:
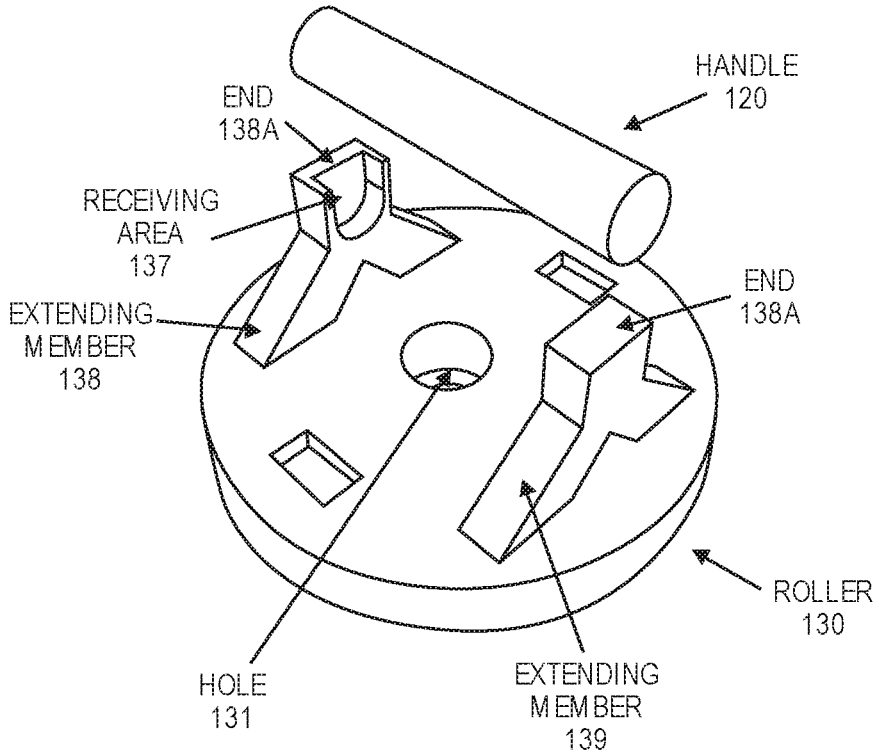

FIGS. 7B and 7C depict a closer view of roller 130. As depicted, extending member 139 includes receiving area 136 configured to receive one end of handle 110. Extending member 138 includes receiving area 137 configured to receive another end of handle 110. Receiving area 136 and 137 are configured somewhat differently. More specifically, receiving area 136 is a circular socket with a closed top near end 139A, whereas receiving area 137 is a semi-circular socket with an open top near end 138A. One end of handle 110 can be inserted length wise essentially straight into receiving area 136. When the one end of handle 110 is inserted into receiving area 136, the other end of handle 110 can be essentially dropped into receiving area 137 through the open top of end 138A.

Also depicted in FIGS. 7B and 7C, roller 130 includes hole 131, which is similar to hole 141 of roller 140.

Figure 8A:
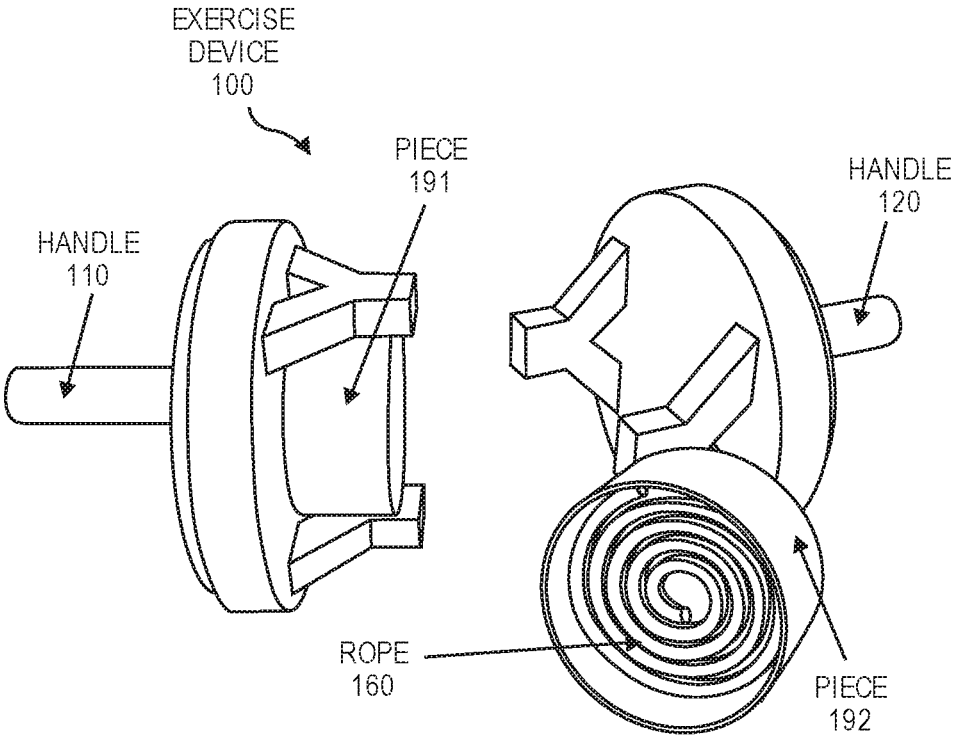
FIGS. 8A-8C illustrate an example alternative two-piece cavity and connecting piece of a multi-purpose exercise device.
Figure 8B:
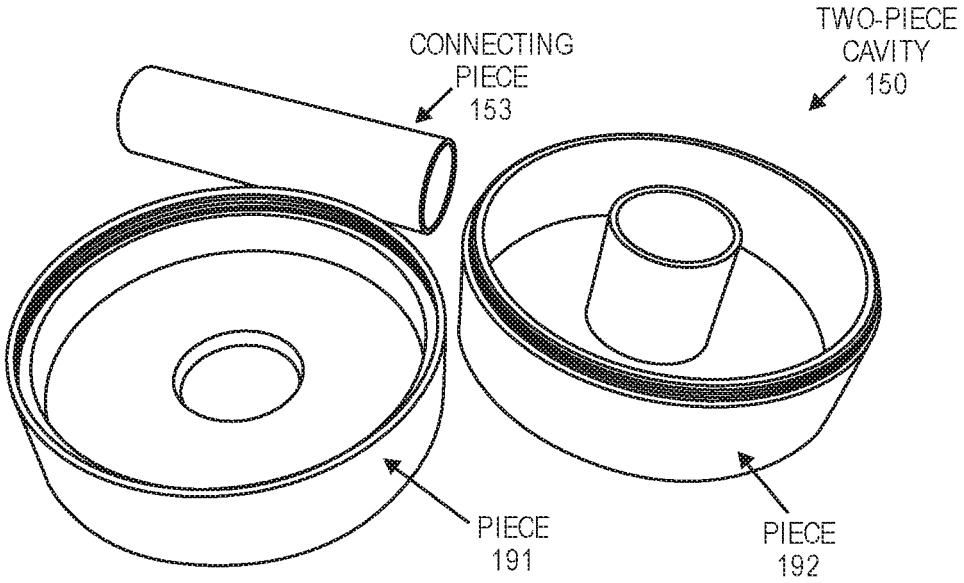
Figure 8C:
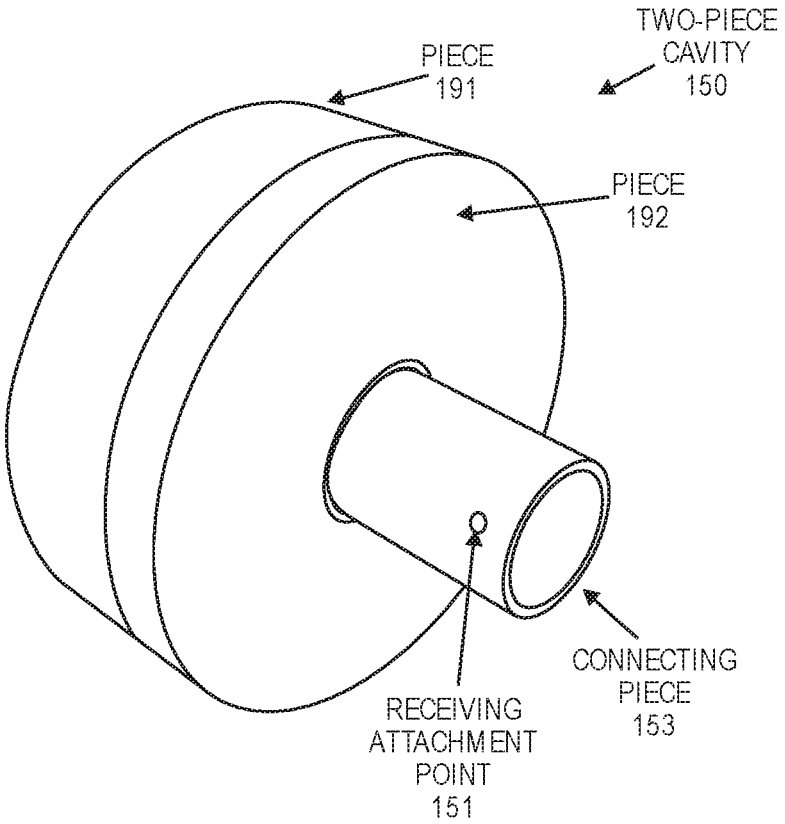

Turning to FIGS. 8A-8C, pieces 191 and 192 of two-piece cavity 150 are depicted in detail. In FIG. 8A, piece 191 is depicted as attached to handle 110 and piece 192 is depicted as detached from piece 191 and handle 120. Furthermore, in FIG. 8A, rope 160 is depicted as being stored within piece 192. In FIG. 8B, a connecting piece 153 is depicted relative to pieces 191 and 192. In one aspect, connecting piece 153 provides extended portions 155 and 156, as well as attachment mechanisms, such as receiving attachment points 151 and 152.

Connecting piece 153 can pass through hole 131 of roller 130, through holes in pieces 191 and 192 of the two-piece cavity 150, and through hole 141 of roller 140. When re-configurable multi-purpose exercise device 100 is configured for abdominal rolling, rope 160 can be contained within two-piece cavity 150 (e.g., as shown in FIG. 8A). As depicted in FIG. 8C, connecting piece 153 passes through the holes of pieces 191 and 192 of two-piece cavity 150. However, in alternative aspects, extended portions 155 and 156 can be integrated into two-piece cavity 150 such that no connecting piece 153 is utilized (e.g., as shown in FIGS. 3, 4 and 5).

Figure 9:
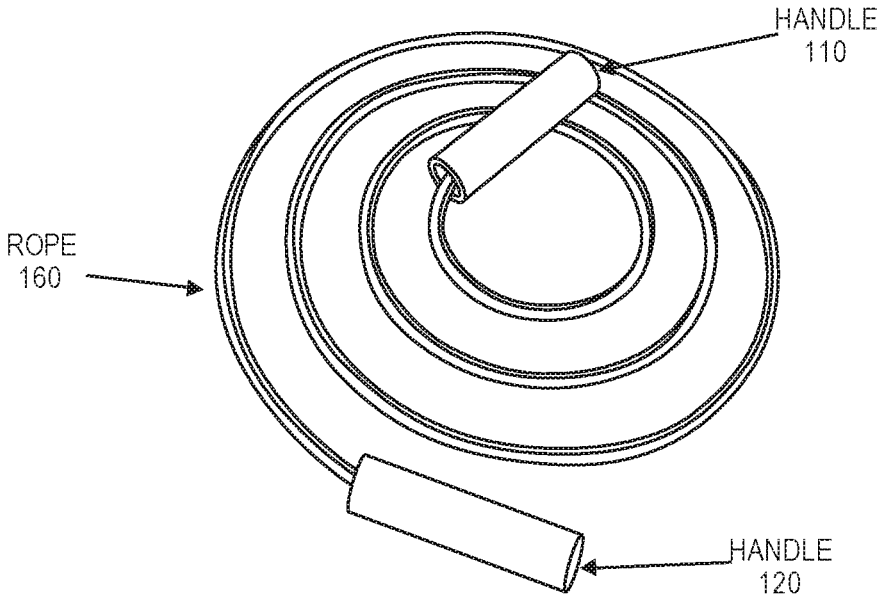
FIG. 9 illustrates the example re-configurable multi-purpose exercise device of FIG. 1 configured for jumping rope.

Turning to FIG. 9, rope 160 is depicted to illustrate the re-configurable multi-purpose exercise device 100 configured for jumping rope. Each end of rope 160 can also include an attachment mechanism (e.g., a hole) similar to receiving attachment mechanisms 151 and 152. As such, each end of rope 160 can be attached to the inserting attachment mechanism of one of handles 110 and 120.

Figure 10A:
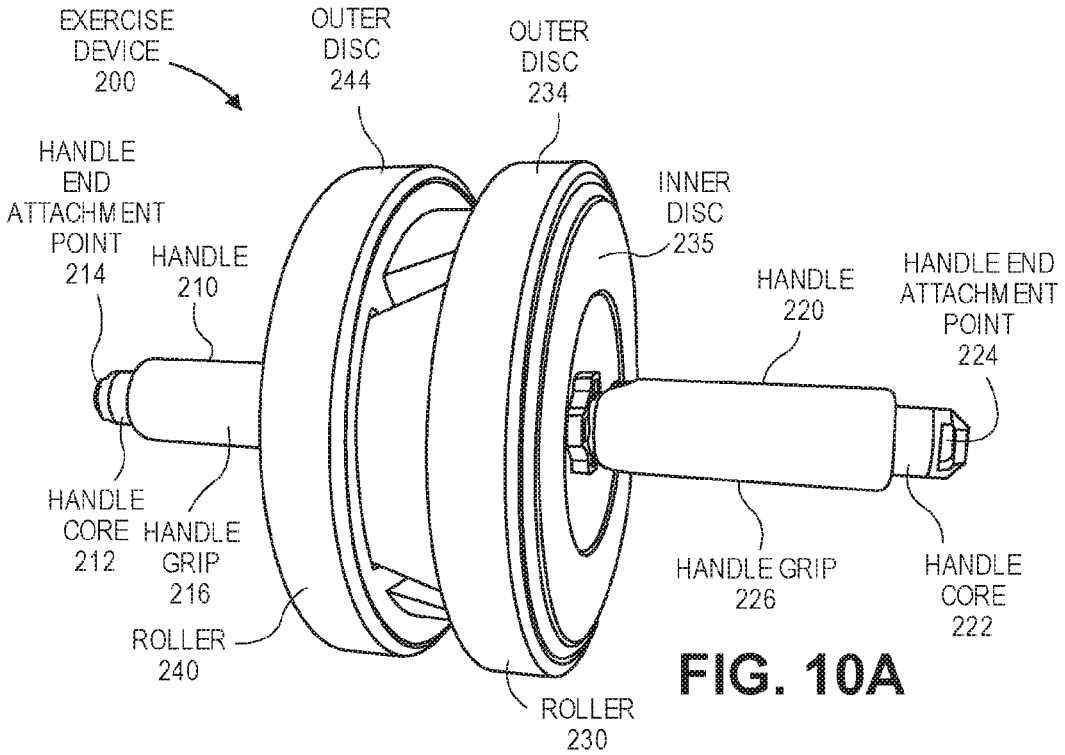
FIGS. 10A-10B illustrate another example re-configurable multi-purpose exercise device configured for abdominal rolling.

FIGS. 10A-12B depict a re-configurable multi-purpose exercise device 200 configured for abdominal rolling. Turning to FIG. 10A, the re-configurable multi-purpose exercise device 200 includes handle 210, handle 220, roller 230, and roller 240. Handle 210 includes handle core 212, handle end attachment point 214, and handle grip 216. Similarly, handle 220 includes handle core 222, handle end attachment point 224, and handle grip 226. FIG. 10A also shows that roller 230 includes outer disc 234 and inner disc 235. Likewise, roller 240 includes outer disc 244 and an inner disc not shown but similar to inner disc 235. In FIG. 10A, handles 210 and 220 attach to rollers 240 and 230 respectively when rollers 240 and 230 face one another. Furthermore, the outer disc and inner disc of each of rollers 230 and 240 can rotate with respect to one another, thereby facilitating use of re-configurable multi-purpose exercise device 200 for abdominal rolling.

Figure 10B:
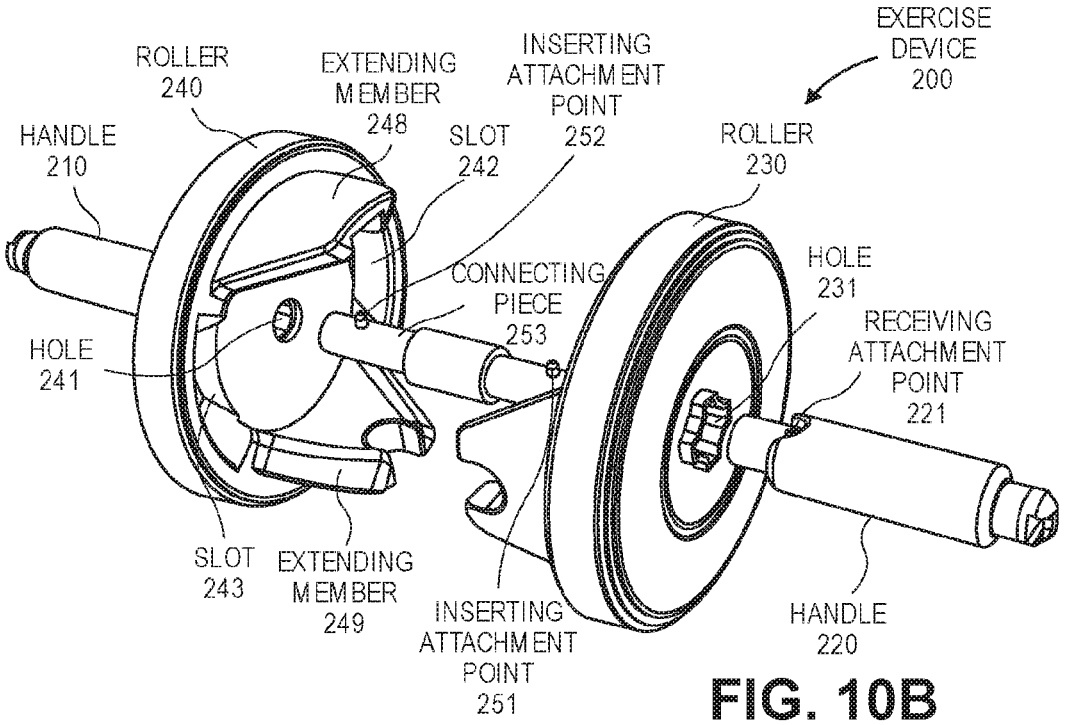

FIG. 10B depicts an exploded view of re-configurable multi-purpose exercise device 200. More specifically, FIG. 10B shows handle 220, which includes receiving attachment point 221, and handle 210, which includes a receiving attachment point similar to receiving attachment point 221.

FIG. 10B also depicts roller 240, which includes hole 241, slot 242, slot 243, extending member 248, extending member 249. Similarly, FIG. 10B shows roller 230 includes hole 231. Additionally, FIG. 10B shows connecting piece 253 which includes inserting attachment point 251 and inserting attachment point 252.

Accordingly, when re-configurable multi-purpose exercise device 200 is configured for abdominal rolling, as depicted in FIG. 10A, handle 210 inserts through hole 241 to attach to connecting piece 253 at inserting attachment point 252. Likewise, handle 220 inserts through hole 231 to attach to connecting piece 253 at inserting attachment point 251. Furthermore, when configured for abdominal rolling, extending members 248 and 249 insert into slots formed on roller 230 (e.g., slots similar to slots 242 and 243 of roller 240). Also, extending members of roller 230 (e.g., extending members similar to extending members 248 and 249 of roller 240) insert into slots 242 and 243 of roller 240. Consequently, handles 210 and 220, rollers 230 and 240, and connecting piece 253 can be secured together such that re-configurable multi-purpose exercise device 200 can be used as an abdominal roller.

Figure 11A:
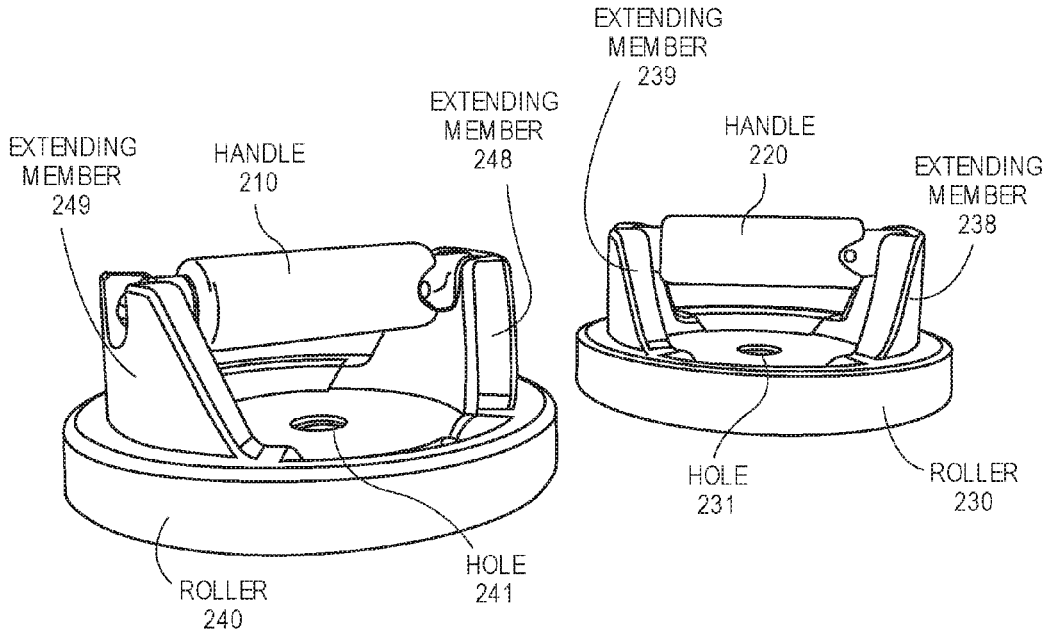
FIGS. 11A-11B illustrate the other example re-configurable multi-purpose exercise device of FIGS. 10A-10B configured for pushups.

Turning to FIG. 11A, re-configurable multi-purpose exercise device 200 is configured for pushups. More specifically, handle 210 is attached to roller 240 by inserting the ends of handle 210 into extending members 248 and 249. Likewise, handle 220 is attached to roller 230 by inserting the ends of handle 220 into extending members 238 and 239 of roller 230. Moreover, the inner discs of rollers 230 and 240 (e.g., inner disc 235 of roller 230) are placed flat on a support surface. Given that inner discs and outer discs of rollers 230 and 240 (e.g., outer disc 234 and inner disc 235 of roller 230) can rotate with respect to one another, re-configurable multi-purpose exercise device 200 can be used to perform rotating pushups when configured as shown in FIG. 11A.

Figure 11B:
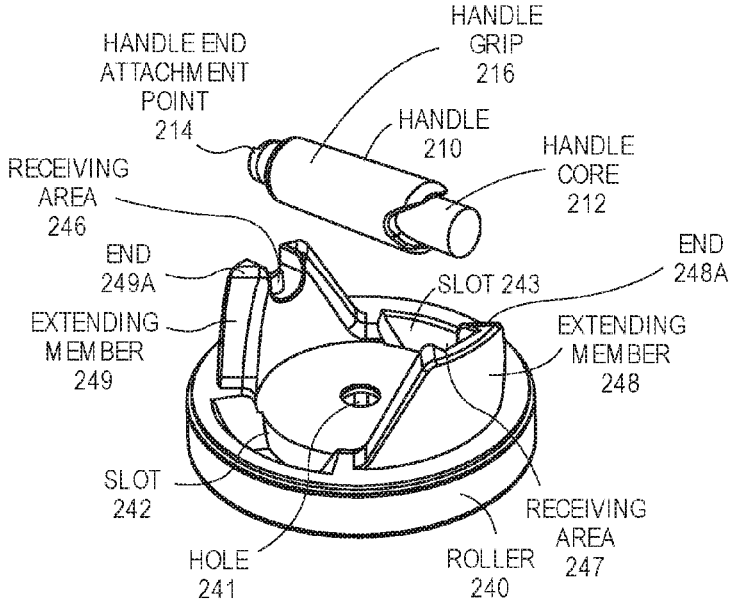

Turning to FIG. 11B, an exploded view of handle 210 and roller 240 is depicted. In particular, FIG. 11B shows that extending member 248 includes receiving area 247 and end 248A. Similarly, extending member 249 includes receiving area 246 and end 249A. Thus, handle 210 attaches to roller 240 by inserting handle core 212 into receiving area 247 at end 248A and inserting handle end attachment point 214 into receiving area 246 at end 249A. As depicted in FIG. 11B, handle end attachment point 214 of handle 210 can attach to roller 240 at end 249A by engaging a tooth formed on the receiving area 246. Likewise, a handle end attachment point of handle 220 can attach to roller 230 by engaging a tooth formed on a receiving end of extending member 239.

Figure 12B:
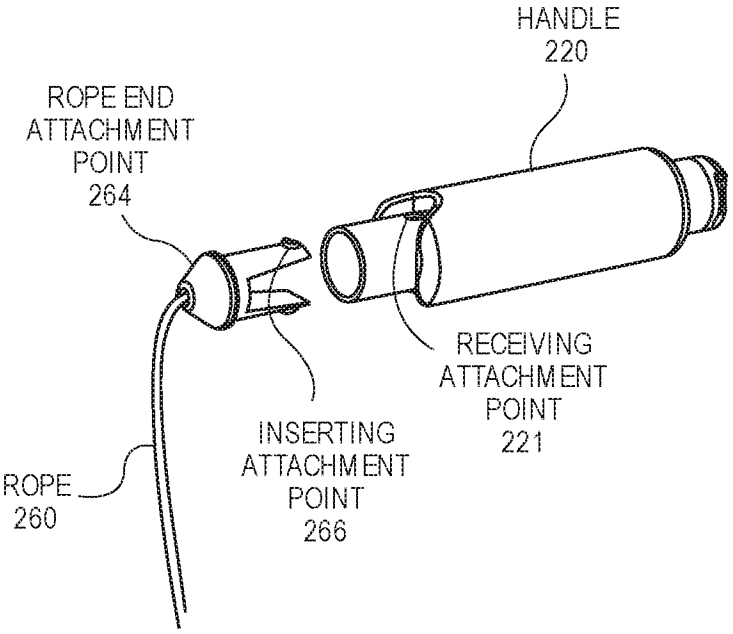
FIGS. 12A-12B illustrate the other example re-configurable multi-purpose exercise device of FIGS. 10A-10B configured for jumping rope.
Figure 12A:
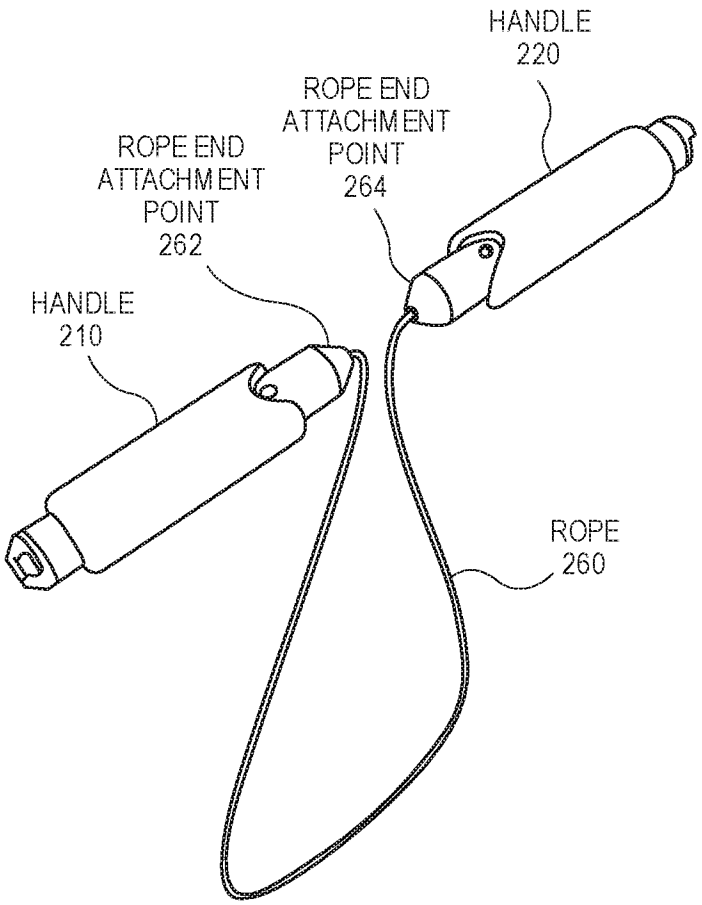

Turning to FIG. 12A, the re-configurable multi-purpose exercise device is configured for jumping rope. More specifically, as depicted in FIG. 12A, re-configurable multi-purpose exercise device includes a rope 260. Rope 260 includes rope end attachment point 262 and rope end attachment point 264 which attach to handle 210 and handle 220 for use in jumping rope.

Turning to FIG. 12B, a close-up view of handle 220 and rope 260 is depicted. In particular, rope 260 includes rope end attachment point 264 which includes inserting attachment point 266. As shown in FIG. 12B, inserting attachment point 266 can be a u-shaped clip mechanism. As also shown in FIG. 12B, handle 220 can include receiving attachment point 221. Rope 260 can be configured for jumping rope by inserting attachment point 266 of rope end attachment point 264 into receiving attachment point 221 of handle 220 to attach rope 260 to handle 220. Similar mechanisms can be used to attach rope end attachment point 262 to handle 210. In other aspects, the ends of rope 260 and handles 210 and 220 can include other compatible attachment mechanisms.

Figure 13:
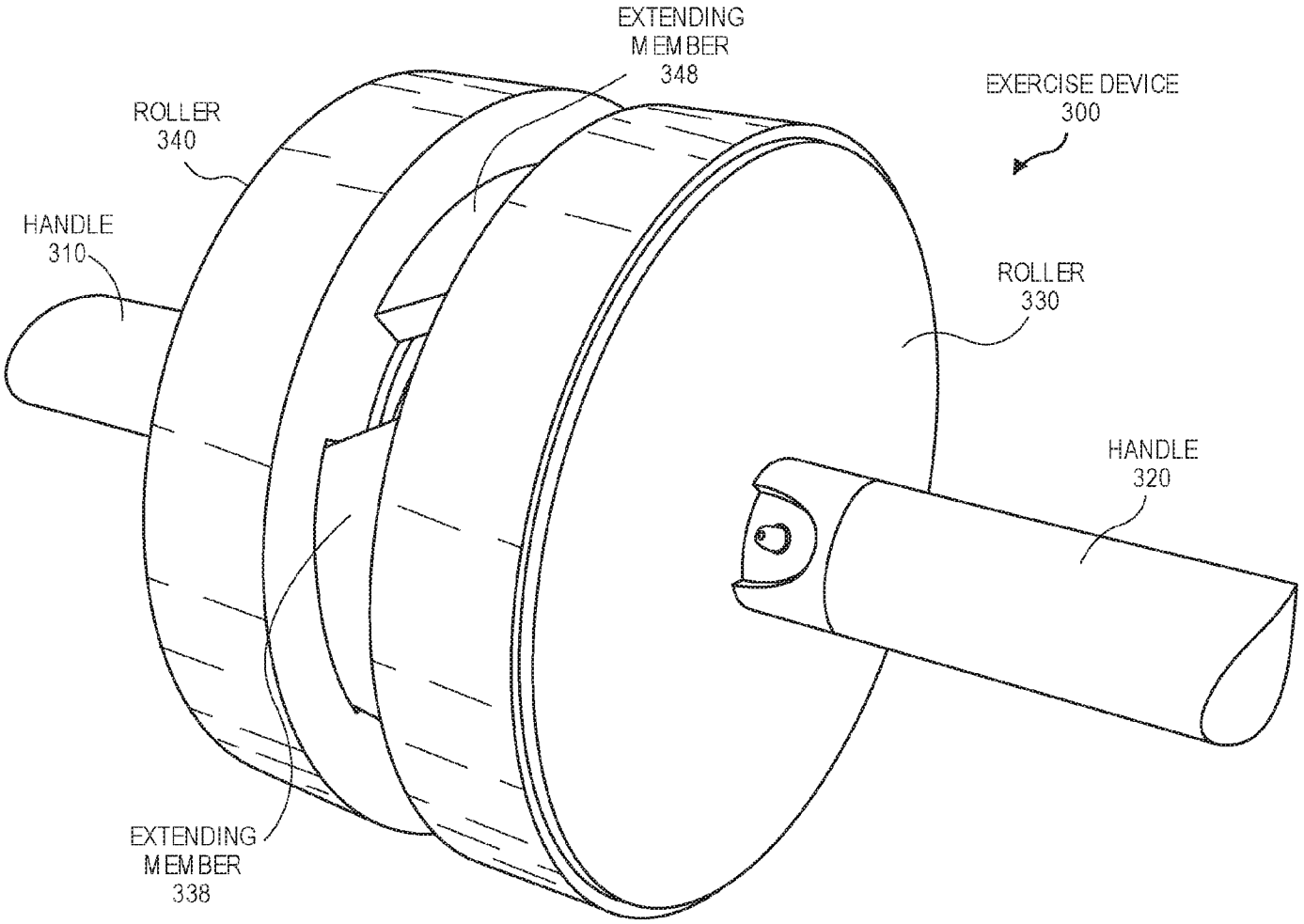
FIG. 13 illustrates a further example re-configurable multi-purpose exercise device configured for abdominal rolling.
Figure 14A:
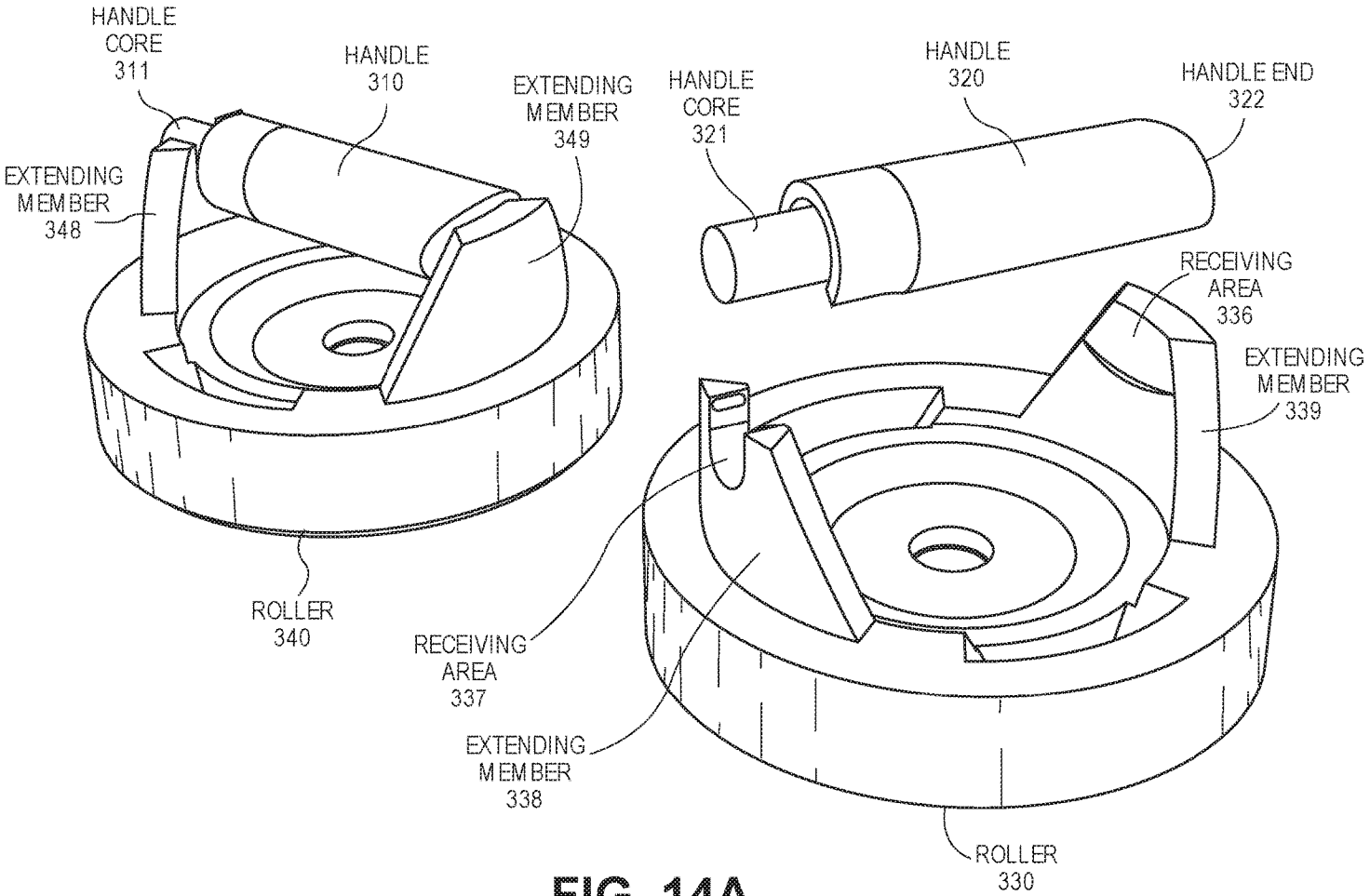
FIGS. 14A-14B illustrate the further example re-configurable multi-purpose exercise device of FIG. 13 configured for pushups.
Figure 14B:
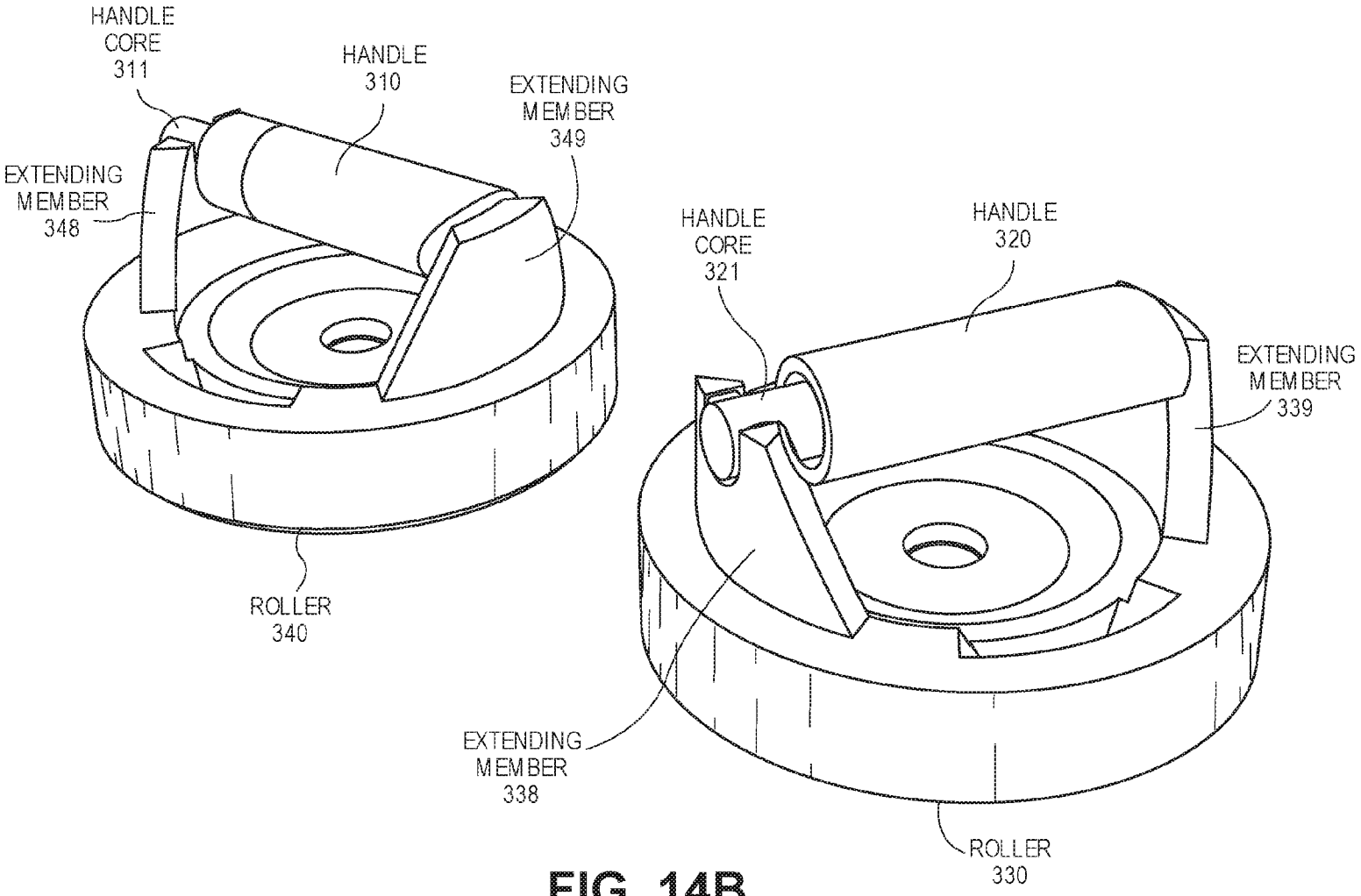
Figure 15:
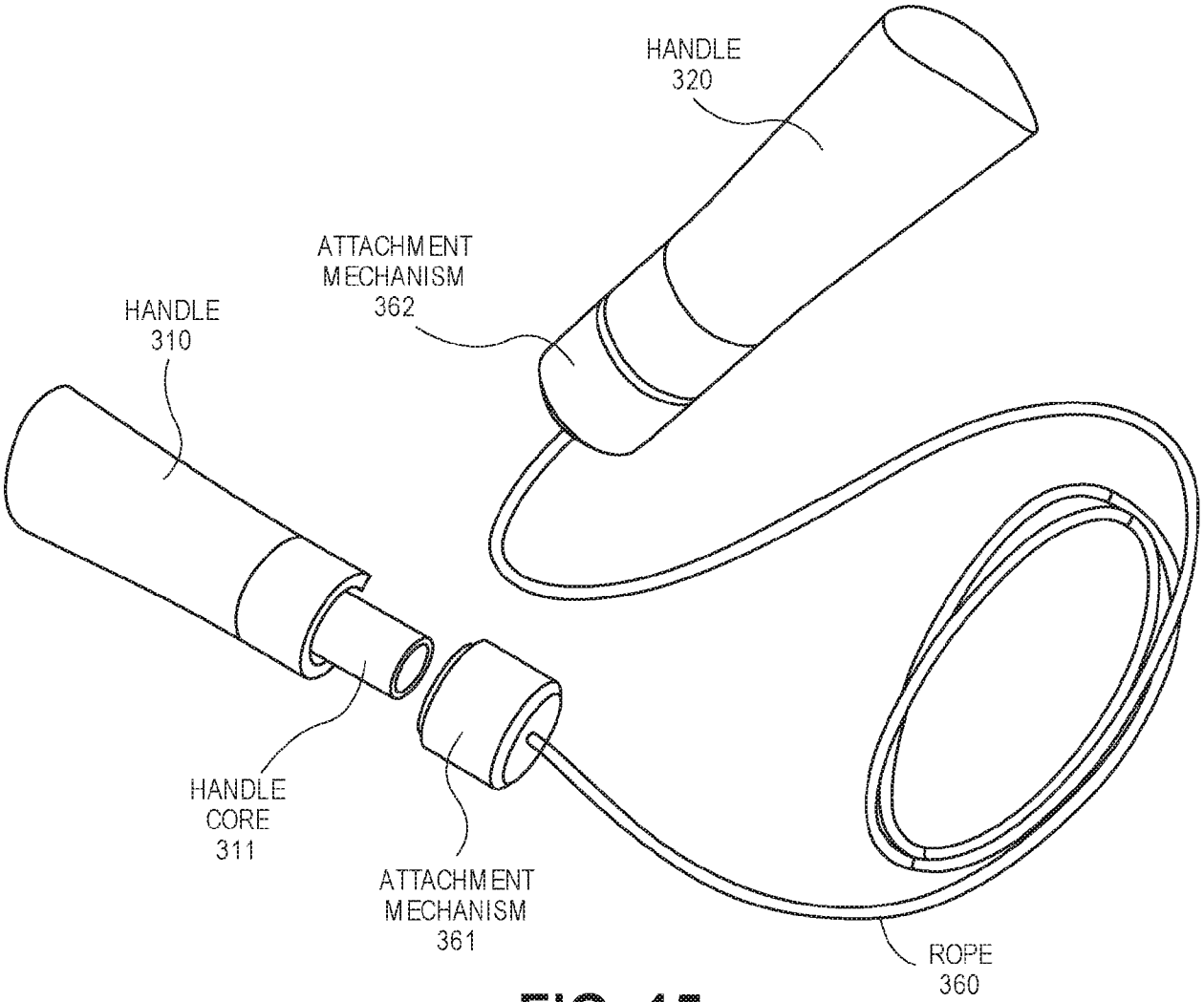
FIG. 15 illustrates the further example re-configurable multi-purpose exercise device of FIG. 13 configured for jumping rope.

FIGS. 13-15 depict a re-configurable multi-purpose exercise device 300. Re-configurable multi-purpose exercise device 300 includes handles 310 and 320 and rollers 330 and 340. Roller 330 includes extending member 338 which inserts into a slot of roller 340. Similarly, roller 340 includes extending member 348 which inserts into a slot of roller 330. In the configuration of FIG. 13, re-configurable multi-purpose exercise device 300 can be used for abdominal rolling.

FIG. 14A depicts handle 310 attached to roller 340 and handle 320 detached relative to roller 330. One end of handle 310 is connected to extending member 349 of roller 340. Handle core 311 of handle 310 is then inserted into a receiving portion of extending member 348 of roller 340. Roller 330 includes extending members 338 and 339. Extending member 338 includes receiving area 337 and extending member 339 includes receiving area 336. Handle end 322 of handle 320 can be attached to extending member 339 at receiving area 336. Handle core 321 can be inserted into extending member 338 at receiving area 337.

FIG. 14B depicts handle 320 attached to roller 330. In the configuration shown in FIG. 14B, the re-configurable multi-purpose exercise device can be used for pushups. In alternative aspects, the rollers 330 and 340 can rotate with respect to a support surface, thereby facilitating use of the re-configurable multi-purpose exercise device for performing rotating pushups.

FIG. 15 depicts rope 360 with attachment mechanisms 361 and 362. Each of attachment mechanisms 361 and 362 can be configured to attach and secure one of the handle core components of handles 310 and 320 (e.g., handle core 311 of handle 310). As depicted, the handle core of handle 320 has been inserted into attachment mechanism 362. Handle core 311 can be inserted into attachment mechanism 361. When handles 310 and 320 are attached to attachment components 361 and 362 respectively, rope 360 can be used for jumping rope.

Figure 16:
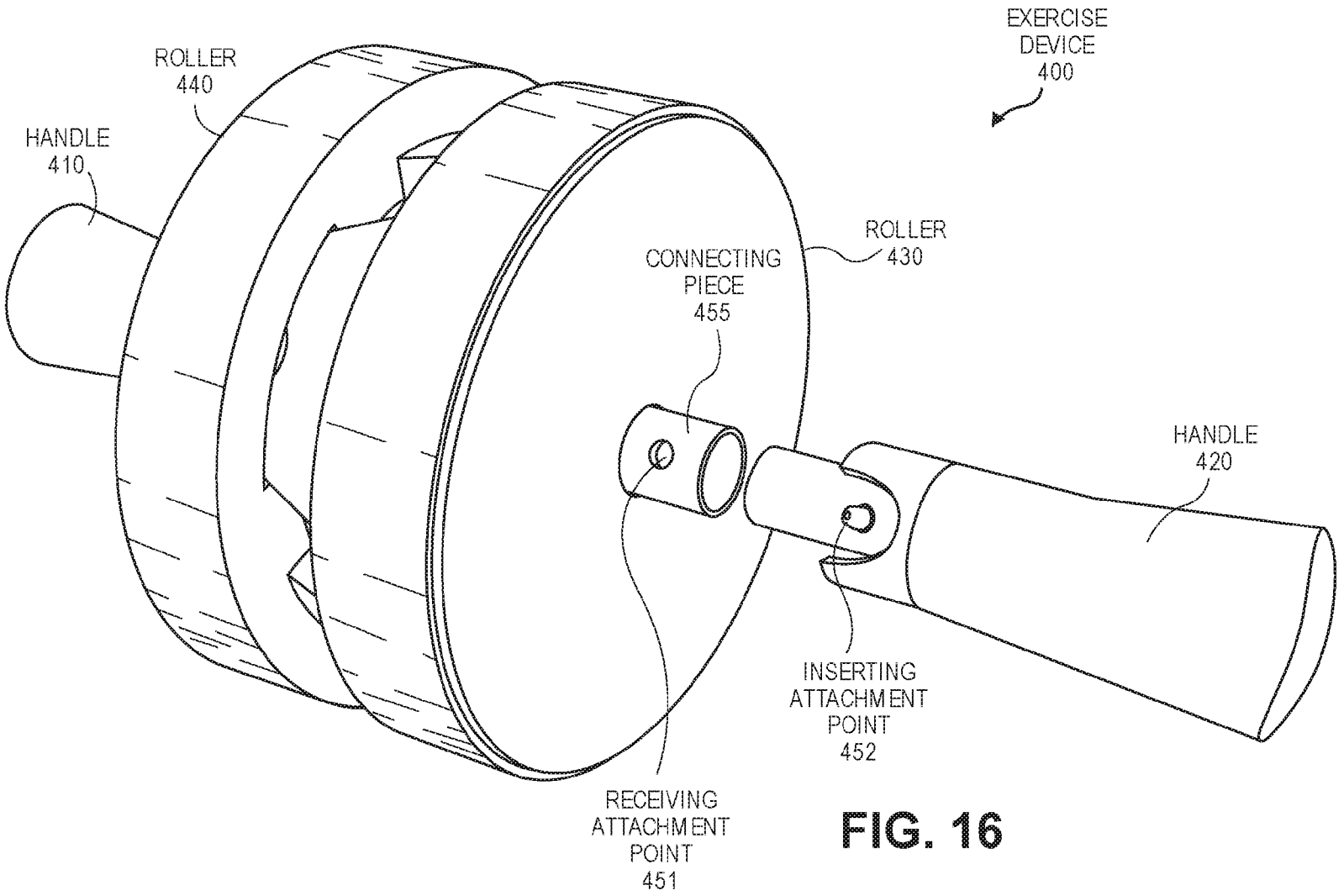
FIG. 16 illustrates removal of an example handle from an additional example re-configurable multi-purpose exercise device.

Turning to FIG. 16, FIG. 16 depicts a re-configurable multi-purpose exercise device 400. Re-configurable multi-purpose exercise device 400 includes handles 410 and 420 and rollers 430 and 440. Connecting piece 455 (which can be associated with a two-piece cavity arranged between rollers 430 and 440) includes an attachment mechanism (i.e., receiving attachment point 451, which can be a hole). Handle 420 includes a corresponding attachment mechanism (i.e., inserting attachment point 452, which can be a depressible spring-loaded component). A user can manipulate inserting attachment point 452 relative to receiving attachment point 451 to attach handle 420 to connecting piece 455. A user can perform similar activities to attach handle 410 to connection piece 455.

Figure 17:
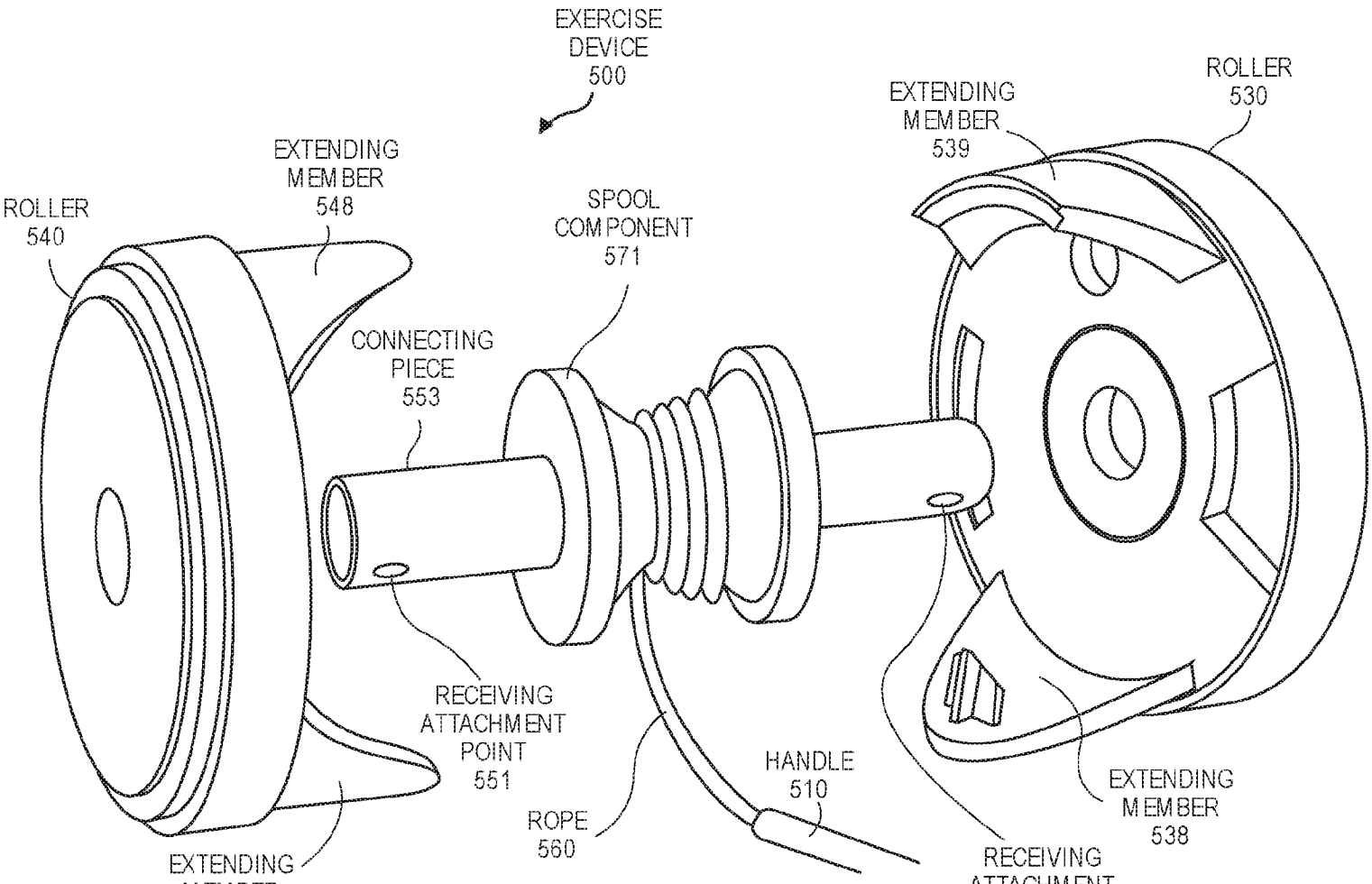
FIG. 17 illustrates an additional further example re-configurable multi-purpose exercise device having an example spool component.

Turning to FIG. 17, FIG. 17 depicts a re-configurable multi-purpose exercise device 500. Re-configurable multi-purpose exercise device 500 includes rollers 530 and 540. Roller 530 further includes extending members 538 and 539. Roller 540 further includes extending members 548 and 549. Connecting piece 553 includes receiving attachment points 551 and 552 (e.g., holes) to attach to handles (e.g., similar to any of handles 410 and 420 of FIG. 16). A user can manipulate an inserting attachment point of a handle relative to receiving attachment point 551 or 552 to attach or detach the handle to connecting piece 553.

As depicted in FIG. 17, re-configurable multi-purpose exercise device 500 also includes spool component 571. Spool component 571 can be connected to connecting piece 553 (e.g., as an integrated single molded piece). Alternatively, spool component 571 can be a separate piece (e.g., a piece that slides over connecting piece 553). More specifically, spool component 571 can include a hole such that connecting piece 553 can be pushed through the hole in spool component 571.

As further depicted in FIG. 17, rope 560 includes a handle 510 and can also include an additional handle on the other end. When not being used, rope 560 can be wrapped around spool component 571 for storage.

When extending members 538, 539, 548, and 549 are used to connect rollers 530 and 540 to one another, spool component 571 can be situated between rollers 530 and 540 (i.e., inside of extending members 538, 539, 548, and 549). Thus, when rope 560 is wrapped around spool component 571, rope 560 is also situated inside rollers 530 and 540 (i.e., inside of extending members 538, 539, 548, and 549).

Figure 18:
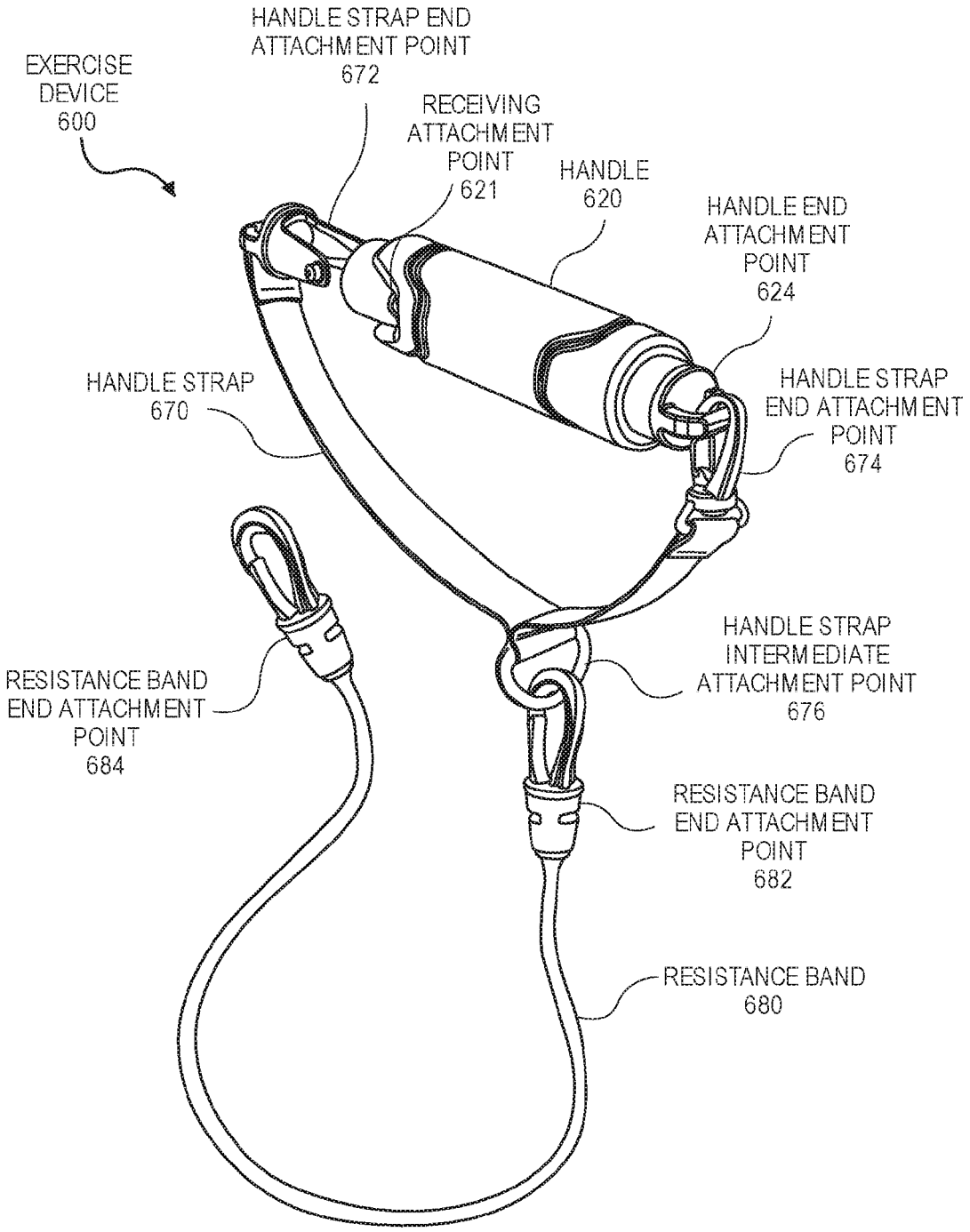
FIG. 18 illustrates the other example re-configurable multi-purpose exercise device of FIGS. 10A-10B configured for resistance band exercises.

Turning to FIG. 18, a re-configurable multi-purpose exercise device 600 (e.g., similar to exercise device 200) is configured for resistance band exercises. More specifically, re-configurable multi-purpose exercise device 600 includes handle 620, handle strap 670, and resistance band 680. Handle 620 includes attachment mechanisms on each end, namely receiving attachment point 621 and handle end attachment point 624. Handle strap 670 also includes attachment mechanisms on each end, namely handle strap end attachment point 672 and handle strap end attachment point 674. Handle strap 670 further includes handle strap intermediate attachment point 676. Resistance band 680 includes attachment mechanisms on each end as well, namely resistance band end attachment points 682 and 684.

In further reference to FIG. 18, handle 620 connects to handle strap 670 to configure the re-configurable multi-purpose exercise device 600 for resistance band exercises. The attachment mechanisms on the ends of handle 620 connect to the attachment mechanisms on the ends of handle strap 670. More specifically, handle strap end attachment point 672 connects to handle 620 by inserting into the end of handle 620 and engaging receiving attachment point 621. Handle strap end attachment point 674 connects to handle 620 by clipping onto the end of handle 620 at handle end attachment point 674. Handle strap end attachment point 672 can be an attachment mechanism similar to rope end attachment point 264 discussed above (i.e., handle strap end attachment point 672 can include an inserting attachment mechanism, such as a u-shaped clip mechanism). Handle strap end attachment point 674 can be an attachment mechanism such as a tension clip.

Handle strap 670 connects to resistance band 680 to configure the re-configurable multi-purpose exercise device 600 for resistance band exercises. More particularly, one of the ends of resistance band 680 (e.g., resistance band end attachment point 682) connects to handle strap intermediate attachment point 676. The other end of resistance band 680 (e.g., resistance band end attachment point 684) can connect to a support structure or to an end of the other handle not shown. Handle strap intermediate attachment point 676 can be an attachment mechanism, such as a D-ring, that is located between handle strap end attachment points 672 and 674 on handle strap 670.

Resistance band end attachment points 682 and 684 can be attachment mechanisms similar to handle strap end attachment point 674 (i.e., a tension clip). Alternatively, resistance band end attachment points 682 and 684 can be attachment mechanisms that are compatible with handle strap intermediate attachment point 676. Once handle 620 is connected to handle strap 670 and handle strap 670 is connected to resistance band 680, the re-configurable multi-purpose exercise device 600 can be used to perform resistance band exercises once the free end of resistance band 680 is connected to a support structure or another handle.

While FIG. 18 depicts handle 620, handle strap 670, and resistance band 680, re-configurable multi-purpose exercise device 600 can include a pair of such handles, a pair of such handle straps, and a pair of such resistance bands. Furthermore, re-configurable multi-purpose exercise device 600 can also include a pair of rollers, a connecting piece, and a rope (e.g., such as rollers 230 and 240 of FIGS. 10A-11B, connecting piece 253 of FIG. 10B, and rope 260 of FIGS. 12A-12B). Additionally, re-configurable multi-purpose exercise device 600 can include a carrying case to configured to efficiently store and transport the forgoing components.

The present described aspects may be implemented in other specific forms without departing from its spirit or essential characteristics. The described aspects are to be considered in all respects only as illustrative and not restrictive. The scope is, therefore, indicated by the appended claims rather than by the foregoing description. All changes which come within the meaning and range of equivalency of the claims are to be embraced within their scope.

What is claimed:

1. A multi-purpose exercise device, comprising:

a first handle and a second handle, each of the first handle and the second handle including an attachment mechanism;

a first roller, the first roller having a first side, the first side including a first extending member and a second extending member that extend out of the first side, a hole passing through the first roller, the first extending member and the second extending member that extend out of the first side of the first roller collectively configured to receive one of the first handle or the second handle to configure the multi-purpose exercise device for pushups;

a second roller, the second roller having a first side, the first side including a first extending member and a second extending member that extend out of the first side, a hole passing through the second roller, the first extending member and the second extending member that extend out of the first side of the second roller collectively configured to receive one of the first handle or the second handle to configure the multi-purpose exercise device for pushups;

a connecting piece configured to pass through the hole passing through the first roller and the hole passing through the second roller, each end of the connecting piece including an attachment mechanism for attaching to the attachment mechanism of one of the first handle or the second handle to configure the multi-purpose exercise device for abdominal rolling; and a rope including, at each end of the rope, an attachment mechanism for attaching to the attachment mechanism of one of the first handle or the second handle to configure the multi-purpose exercise device for jumping rope.

2. The multi-purpose exercise device of claim 1, further comprising:

an inner disc on each of the first roller and the second roller;

an outer disc on each of the first roller and the second roller;

wherein the inner disc of the first roller is configured to rotate with respect to the outer disc of the first roller and the inner disc of the second roller is configured to rotate with respect to the outer disc of the second roller.

3. The multi-purpose exercise device of claim 1, further comprising the multi-purpose exercise device being configured for jumping rope, including:

the attachment mechanism of one of the first handle or the second handle attached to the attachment mechanism at one end of the rope; and the attachment mechanism of the other of the first handle or the second handle attached to the attachment mechanism at the other end of the rope.

4. The multi-purpose exercise device of claim 1, further comprising the multi-purpose exercise device being configured for resistance band exercises, including:

a first handle strap and a second handle strap, each handle strap including at one end a first handle strap end attachment point for attaching to the attachment mechanism of one of the first handle or the second handle, at another end a second handle strap end attachment point for attaching to a handle end attachment point of the one of the first handle or the second handle, each of the first handle strap and the second handle strap further including a handle strap intermediate attachment point;

a resistance band, at each end of the resistance band, an attachment mechanism for attaching to the handle strap intermediate attachment point of the first handle strap or the second handle strap to configure the multi-purpose exercise device for resistance band exercises;

the first handle strap end attachment point of the first handle strap attached to the attachment mechanism of one of the first handle or the second handle;

the second handle strap end attachment point of the first handle strap attached to the handle end attachment point of the one of the first handle or the second handle;

the handle strap intermediate attachment point of the first handle strap attached to the attachment mechanism at one end of the resistance band;

the first handle strap end attachment point of the second handle strap attached to the attachment mechanism of the other of the first handle or the second handle;

the second handle strap end attachment point of the second handle strap attached to the handle end attachment point of the other of the first handle or the second handle; and the handle strap intermediate attachment point of the second handle strap attached to the attachment mechanism at the other end of the resistance band.

5. The multi-purpose exercise device of claim 1, further comprising the multi-purpose exercise device being configured for pushups, including:

one of the first handle or the second handle received by the first extending member and the second extending member that extend out of the first side of the first roller; and the other of the first handle or the second handle received by the first extending member and the second extending member that extend out of the first side of the second roller.

6. The multi-purpose exercise device of claim 5, further comprising:

a receiving area on an end of each of the first extending member and the second extending member that extend out of the first side of the first roller, the receiving area on the end of the first extending member attached to a handle end attachment point of one of the first handle or the second handle and the receiving area on the end of the second extending member attached to a handle core of the one of the first handle or the second handle; and a receiving area on an end of each of the first extending member and the second extending member that extend out of the first side of the second roller, the receiving area on the end of the first extending member attached to a handle end attachment point of the other of the first handle or the second handle and the receiving area on the end of the second extending member attached to a handle core of the other of the first handle or the second handle.

7. The multi-purpose exercise device of claim 1, further comprising the multi-purpose exercise device being configured for abdominal rolling, including:

the first side of the first roller faced to the first side of the second roller;

the connecting piece passed through the hole passing through the first roller and the hole passing through the second roller;

the attachment mechanism of one of the first handle or the second handle attached to the attachment mechanism at one end of the connecting piece; and the attachment mechanism of the other of the first handle or the second handle attached to the attachment mechanism at the other end of the connecting piece.

8. The multi-purpose exercise device of claim 7, further comprising:

the first extending member and the second extending member that extend out of the first side of the first roller being respectively secured into a first slot and a second slot formed in the first side of the second roller; and the first extending member and the second extending member that extend out of the first side of the second roller being respectively secured into a first slot and a second slot formed in the first side of the first roller.

9. The multi-purpose exercise device of claim 8, further comprising:

an inserting attachment point of one of the first handle or the second handle attached to a receiving attachment point at one end of the connecting piece; and an inserting attachment point of the other of the first handle or the second handle attached to a receiving attachment point at the other end of the connecting piece.

10. The multi-purpose exercise device of claim 8, further comprising:

a receiving attachment point of one of the first handle or the second handle attached to an inserting attachment point at one end of the connecting piece; and a receiving attachment point of the other of the first handle or the second handle attached to an inserting attachment point at the other end of the connecting piece.

11. The multi-purpose exercise device of claim 10, further comprising a spool component formed on the connecting piece, the spool component configured to store the rope.

12. The multi-purpose exercise device of claim 10, further comprising a two-piece cavity formed on the connecting piece, the two-piece cavity configured to store the rope.

13. A multi-purpose exercise device, comprising:

a first handle and a second handle, each of the first handle and the second handle including an attachment mechanism;

a first roller, the first roller including an outer disc and an inner disc, the outer disc and the inner disc are rotatable with respect to one another, the outer disc including a first extending member and a second extending member that extend out of the outer disc, the outer disc also including a first slot and a second slot formed in the outer disc for receiving a first extending member and a second extending member that extend out of an outer disc of a second roller, a hole passing through the outer disc and the inner disc of the first roller, the first extending member and the second extending member that extend out of the outer disc of the first roller collectively configured to receive one of the first handle or the second handle to configure the multi-purpose exercise device for pushups;

the second roller, the second roller including the outer disc and an inner disc, the outer disc and the inner disc are rotatable with respect to one another, the outer disc including the first extending member and the second extending member that extend out of the outer disc, the outer disc also including a first slot and a second slot formed in the outer disc for receiving the first extending member and the second extending member that extend out of the outer disc of the first roller, a hole passing through the outer disc and the inner disc of the second roller, the first extending member and the second extending member that extend out of the outer disc of the second roller collectively configured to receive one of the first handle or the second handle to configure the multi-purpose exercise device for pushups;

a connecting piece configured to pass through the hole passing through the outer disc and the inner disc of the first roller and the hole passing through the outer disc and the inner disc of the second roller, each end of the connecting piece including an attachment mechanism for attaching to the attachment mechanism of one of the first handle or the second handle to configure the multi-purpose exercise device for abdominal rolling; and a rope including, at each end of the rope, an attachment mechanism for attaching to the attachment mechanism of one of the first handle or the second handle to configure the multi-purpose exercise device for jumping rope.

14. The multi-purpose exercise device of claim 13, further comprising the multi-purpose exercise device being configured for abdominal rolling, including:

the first extending member and the second extending member that extend out of the outer disc of the first roller being respectively secured into the first slot and the second slot formed in the outer disc of the second roller;

the first extending member and the second extending member that extend out of the outer disc of the second roller being respectively secured into the first slot and the second slot formed in the outer disc of the first roller;

the connecting piece passed through the hole passing through the outer disc and the inner disc of the first roller and the hole passing through the outer disc and the inner disc of the second roller;

the attachment mechanism of one of the first handle or the second handle attached to the attachment mechanism at one end of the connecting piece; and the attachment mechanism of the other of the first handle or the second handle attached to the attachment mechanism at the other end of the connecting piece.

15. The multi-purpose exercise device of claim 13, further comprising the multi-purpose exercise device being configured for pushups, including:

one of the first handle or the second handle connected to the first extending member and the second extending member that extend out of the outer disc of the first roller; and the other of the first handle or the second handle connected to the first extending member and the second extending member that extend out of the outer disc of the second roller.

16. The multi-purpose exercise device of claim 13, further comprising the multi-purpose exercise device being configured for jumping rope, including:

the attachment mechanism of one of the first handle or the second handle attached to the attachment mechanism at one end of the rope; and the attachment mechanism of the other of the first handle or the second handle attached to the attachment mechanism at the other end of the rope.

17. A multi-purpose exercise device, comprising:

a first handle and a second handle, each of the first handle and the second handle including an inserting attachment point;

a first roller, the first roller having a first side and a second side, the first side including a first extending member and a second extending member that extend out of the first side, the first roller also including a first slot and a second slot formed in the first side, the second side of the first roller being essentially flat, a hole passing through the first roller from the first side to the second side, the first extending member and the second extending member that extend out of the first side of the first roller collectively configured to receive one of the first handle or the second handle to configure the multi-purpose exercise device for pushups;

a second roller, the second roller having a first side and a second side, the first side including a first extending member and a second extending member that extend out of the first side, the second roller also including a first slot and a second slot formed in the first side for receiving the first extending member and the second extending member that extend out of the first side of the first roller, a hole passing through the second roller from the first side of the second side, the first extending member and the second extending member that extend out of the first side of the second roller collectively configured to receive one of the first handle or the second handle to configure the multi-purpose exercise device for pushups;

a two-piece cavity, the two-piece cavity including a first piece and a second piece, the first piece and the second piece are selectively attachable to and detachable from one another, the two-piece cavity configured to store a rope and be contained between the first side of the first roller and the first side of the second roller when (a) the first piece and the second piece are attached to one another, (b) the first extending member and the second extending member that extend out of the first side of the first roller are respectively secured into the first slot and the second slot formed in the first side of the second roller, and (c) the first extending member and the second extending member that extend out of the first side of the second roller are respectively secured into the first slot and the second slot formed in the first side of the first roller, each of the first piece and the second piece including an extended portion configured to pass through either of the hole passing through the first roller or the hole passing through the second roller, each extended portion including a receiving attachment point for attaching to the inserting attachment point of one of the first handle or the second handle to configure the multi-purpose exercise device for abdominal rolling; and a rope including, at each end of the rope, a receiving attachment point for attaching to the inserting attachment point of one of the first handle or the second handle to configure the multi-purpose exercise device for jumping rope.

18. The multi-purpose exercise device of claim 17, further comprising the multi-purpose exercise device being configured for abdominal rolling, including:

the first extending member and the second extending member that extend out of the first side of the first roller being respectively secured into the first slot and the second slot formed in the first side of the second roller;

the first extending member and the second extending member that extend out of the first side of the second roller being respectively secured into the first slot and the second slot formed in the first side of the first roller;

the inserting attachment point of one of the first handle or the second handle attached to the receiving attachment point of the extended portion of one of the first piece of the two-piece cavity or the second piece of the two-piece cavity; and the inserting attachment point of the other of the first handle or the second handle attached to the receiving attachment point of the extended portion of the other of the first piece of the two-piece cavity or the second piece of the two-piece cavity.

19. The multi-purpose exercise device of claim 17, further comprising the multi-purpose exercise device being configured for pushups, including:

one of the first handle or the second handle received by the first extending member and the second extending member that extend out of the first side of the first roller; and the other of the first handle or the second handle received by the first extending member and the second extending member that extend out of the first side of the second roller.

20. The multi-purpose exercise device of claim 17, further comprising the multi-purpose exercise device being configured for jumping rope, including:

the inserting attachment point of one of the first handle or the second handle attached to the receiving attachment point at one end of the rope; and the inserting attachment point of the other of the first handle or the second handle attached to the receiving attachment point at the other end of the rope.

* * * * *